US007079088B2

(12) United States Patent
Koo et al.

(10) Patent No.: US 7,079,088 B2
(45) Date of Patent: Jul. 18, 2006

(54) PLASMA DISPLAY PANEL AND DRIVING METHOD THEREOF

(75) Inventors: Bon-Cheol Koo, Taegu (KR); Eung-Kwan Lee, Taegu (KR); Bong-Koo Kang, Pohang-shi (KR); Young-Hwan Kim, Pohang-shi (KR); Sang-Jin Yun, Pohang-shi (KR); Yun-Kwon Jung, Pohang-shi (KR); Ju-Won Seo, Pohang-shi (KR); Joong-Min Ra, Pohang-shi (KR); Bong-Hyun Lee, Pohang-shi (KR); Hyun-Mok Yu, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 157 days.

(21) Appl. No.: 10/250,899

(22) PCT Filed: Jan. 17, 2002

(86) PCT No.: PCT/KR02/00072

§ 371 (c)(1),
(2), (4) Date: Jul. 10, 2003

(87) PCT Pub. No.: WO02/058041

PCT Pub. Date: Jul. 25, 2002

(65) Prior Publication Data

US 2004/0212557 A1 Oct. 28, 2004

(30) Foreign Application Priority Data

Jan. 18, 2001 (KR) ..... 2001-3005
Mar. 26, 2001 (KR) ..... 2001-15755
Jan. 16, 2002 (KR) ..... 2002-2483

(51) Int. Cl.
*G09G 3/28* (2006.01)

(52) U.S. Cl. ..... 345/60; 315/169.4

(58) Field of Classification Search ..... 345/60, 345/204, 208; 315/169.3, 169.4
See application file for complete search history.

(56) References Cited

U.S. PATENT DOCUMENTS 6,693,608 B1 * 2/2004 Liu et al. ..... 345/60

FOREIGN PATENT DOCUMENTS

| | | |
|---|---|---|
| JP | 06-043829 | 2/1994 |
| JP | 07-160218 | 6/1995 |
| JP | 10-319893 | 12/1998 |
| JP | 2000-206933 | 7/2000 |
| KR | 2002-0088768 | 11/2002 |

* cited by examiner

*Primary Examiner*—David Vu
(74) *Attorney, Agent, or Firm*—Fleshner & Kim LLP

(57) ABSTRACT

A plasma display panel and a driving method thereof that is capable of generating a sinusoidal initialization waveform. In the panel, a sinusoidal wave is used for forming wall charges.

27 Claims, 22 Drawing Sheets

PLASMA DISPLAY PANEL AND DRIVING METHOD THEREOF

BACKGROUND OF THE INVENTION

1. Field of the Invention

This invention relates to a plasma display panel, and more particularly to a plasma display panel that is capable of generating a sinusoidal initialization waveform and a driving method thereof.

2. Description of the Related Art

Generally, a plasma display panel (PDP) is a display device utilizing a visible light emitted from a phosphor layer when an ultraviolet ray generated by a gas discharge excites the phosphor layer. The PDP has an advantage in that it has a thinner thickness and a lighter weight in comparison to an existing cathode ray tube (CRT) and is capable of realizing a high resolution and a large-scale screen. The PDP includes a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell of the conventional three-electrode, AC surface-discharge PDP includes a first electrode 12Y and a second electrode 12Z provided on an upper substrate 10, and an address electrode 20X provided on a lower substrate 18.

On the upper substrate 10 provided with the first electrode 12Y and the second electrode 12Z in parallel, an upper dielectric layer 14 and a protective layer 16 are disposed. Wall charges generated upon plasma discharge are accumulated into the upper dielectric layer 14. The protective layer 16 prevents a damage of the upper dielectric layer 14 caused by a sputtering during the plasma discharge and improves the emission efficiency of secondary electrons. This protective layer 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier rib 24 are coated with a phosphor layer 26. The address electrode 20X is formed in a direction crossing the first electrode 12Y and the second electrode 12Z.

The barrier rib 24 is formed in parallel to the address electrode 20X to prevent an ultraviolet ray and a visible light generated by a discharge from being leaked to the adjacent discharge cells. The phosphor layer 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

FIG. 2 shows a driving apparatus for the conventional three-electrode, AC surface-discharge type PDP.

Referring to FIG. 2, the driving apparatus for the conventional three-electrode, AC surface-discharge type PDP includes a PDP 30 having m×n discharge cells 1 arranged in a matrix type in such a manner to be connected to first electrode lines Y1 to Ym, second electrode lines Z1 to Zm and address electrode lines X1 to Xn, a first sustain driver 32 for driving the first electrode lines Y1 to Ym, a second sustain driver 34 for driving the second electrode lines Z1 to Zm, and first and second address drivers 36A and 36B for proving a divisional driving of odd-numbered address electrode lines X1, X3, . . . , Xn−3, Xn−1 and even-numbered address electrode lines X2, X4, . . . , Xn−2, Xn.

The first sustain driver 32 sequentially applies a scan pulse to the first electrode lines Y1 to Ym. Further, the first sustain driver 32 commonly applies a sustain pulse to the first electrode lines Y1 to Ym. The second sustain driver 34 applies a sustain pulse to all the second electrode lines Z1 to Zm. The first and second address drivers 36A and 36B supplies the address electrode lines X1 to Xn with an image data in such a manner to be synchronized with the scan pulse. The first address driver 36A supplies the odd-numbered address electrodes X1, X3, . . . , Xn−3, Xn−1 with an image data while the second address driver 36B supplies the even-numbered address electrode lines X2, X4, . . . , Xn−2, Xn with an image data.

Such a three-electrode AC surface-discharge PDP drives one frame, which is divided into various sub-fields having a different discharge frequency, so as to express gray levels of a picture. Each sub-field is again divided into an initialization period for uniformly causing a discharge, an address period for selecting the discharge cell and a sustain period for realizing the gray levels depending on the discharge frequency. For instance, when it is intended to display a picture of 256gray levels, a frame interval equal to 1/60 second (i.e. 16.67 msec) is divided into 8 sub-fields SF1 to SF8. Each of the 8 sub-fields SF1 to SF8 is divided into an address period and a sustain period. The initialization period and the address period of each sub-field are equal every sub-field, whereas the sustain period are increased at a ratio of $2^n$(wherein n=0, 1, 2, 3, 4, 5, 6 and 7) at each sub-field.

In the mean time, the PDP is largely classified into a selective writing system and a selective erasing system depending upon an emission type of a discharge cell selected by an address discharge.

The selective writing system turns on discharge cells selected in the address period after turning off the entire field in the initialization period. Subsequently, it makes a sustain discharge of discharge cells selected by the address discharge in the sustain period to thereby display a picture.

On the other hand, the selective erasing system turn off discharge cells selected in the address period after turning on the entire field in the initialization period. Subsequently, it makes a sustain discharge of discharge cells unselected by the address discharge in the sustain period.

FIG. 4 illustrates a driving waveform applied to each electrode line of the PDP for each sub-field in the conventional selective writing driving system.

Referring to FIG. 4, one sub-field is divided into an initialization period for initializing the entire field, an address period for writing a data while scanning the entire field on a line-sequence basis, and a sustain period for keeping light-emission states of cells into which a data has been written.

First, in the initialization period, an initialization waveform RP is applied to the first electrode lines Y1 to Ym. If the initialization waveform RP is applied to the first electrode lines Y1 to Ym, then an initialization discharge is generated between the first electrode lines Y1 to Ym and the second electrode lines Z1 to Zm to initialize a discharge cell. At this time, a misfiring prevention pulse is applied to the address electrode lines X1 to Xn.

In the address period, a scan pulse −Vs is sequentially applied to the first electrode lines Y1 to Ym. A data pulse Vd synchronized with the scan pulse −Vs is applied to the address electrode lines X1 to Xn. At this time, an address discharge occurs at the discharge cells to which the data pulse Vd and the scan pulse −Vs.

In the sustain period, first and second sustain pulses SUSPy and SUSPz are applied to the first electrode lines Y1 to Ym and the second electrode lines Z1 to Zm, respectively.

Meanwhile, a rectangular initialization waveform shown in FIG. 4 causes a strong initialization discharge at the discharge cells to lead the discharge cells into a certain state. However, if a strong initialization discharge occurs at the discharge cells, then the corresponding light is generated to cause contrast deterioration. In order to compensate for such a drawback, there has been a ramp waveform as shown in FIG. 5.

FIG. 5 illustrates a driving waveform applied to each electrode line of the conventional PDP.

Referring to FIG. 5, a ramp waveform R with a rising slope Ru and a falling slope Rd is applied to the first electrode lines Y1 to Ym in the initialization period. In the rising interval Ru of the ramp waveform R, a slowly rising voltage is applied to the discharge cells. If a voltage rises slowly within the discharge cell, then a current flowing through a discharge gas is limited. Thus, a wall charge is formed within the discharge cell by a number of dark discharges. On the other hand, in a falling interval Rd of the ramp waveform R, a slowly falling voltage is applied to the discharge cells. In such a falling interval Rd of the ramp waveform R, a wall charge amount within the cell is reduced by the dark discharges and a final wall charge amount is uniformed between all the discharge cells.

Meanwhile, since the ramp waveform R causes a dark discharge at the discharge cell, a weak light is generated in the initialization period. Accordingly, a quantity of light generated in the initialization period is reduced to improve a contrast of the PDP.

FIG. 6 shows a circuit diagram of a ramp waveform generating device.

Referring to FIG. 6, a conventional ramp waveform generating device includes a rising ramp waveform generating device part 40 and a falling ramp waveform generating device part 42.

The rising ramp waveform generating device 40 includes a first switching device M1 provided between a ramp waveform voltage source Vcc and a first electrode Y, a first capacitor C1 provided between a gate electrode of the first switching device M1 and the ramp waveform voltage source Vcc, and a first variable resisting device VR1 provided between the gate electrode of the first switching device M1 and a first ramp control signal generating device 44.

Diodes D2, D3 and D4 for preventing a backward current and resisting devices R3 and R5 for protecting these diodes are provided between the gate electrode of the first switching device M1 and the first ramp control signal generating device 44. A fourth resisting device R4 is arranged between the first variable resisting device VR1 and the first ramp control signal generating device 44. This resisting device R4 is provided to reduce a varying range of the first variable resisting device VR1. A first diode D1 and a first resisting device R1 are connected, in parallel, between the first capacitor C1 and the ramp waveform voltage source Vcc. A second resisting device R2 for protecting the first capacitor C1 is provided between the first diode D1 and the first capacitor C1.

An operation of the rising ramp waveform generating device 40 will be described. First, a ramp control signal generated from the first ramp control signal generating device 44 is applied, via the fourth resisting device R4 and the first variable resisting device VR1, to the first switching device M1. At this time, the ramp control signal applied to the first switching device M1 has a slope resulting from resistance values of the first variable resisting device VR1 and the fourth resistor R4 and a capacitance of the first capacitor C1. In other words, a voltage applied to the gate electrode rises slowly owing to resistances of the first variable resisting device VR1 and the fourth resisting device R4 and a capacitance of the first capacitor C1. Accordingly, a voltage applied from the ramp waveform voltage source Vcc, via the first switching device M1, to the first electrode Y has a rising slope.

The falling ramp waveform generating device 42 includes a second switching device M2 provided between a ground level source GND and a first electrode Y, a second capacitor C2 provided between a gate electrode and a drain electrode of the second switching device M2, and a second variable resisting device VR2 provided between the gate electrode of the second switching device M2 and a second ramp control signal generating device 46.

A fifth diode D5 for controlling a current flow is provided between the gate electrode of the second switching device M2 and the second ramp control signal generating device 46. A sixth resisting device R6 for protecting the fifth diode D5 is provided between the fifth diode D5 and the second ramp control signal generating device 46. A ninth resisting device R9 is arranged between the second variable resisting device VR2 and the second ramp control signal generating device 46. This ninth resisting device R9 is provided to reduce a varying range of the second variable resisting device VR2. A sixth diode D6 and an eighth resisting device R8 are connected, in parallel, between the drain electrode of the second switching device M2 and the second capacitor C2. A seventh resisting device R7 for protecting the second capacitor C2 is provided between the sixth diode D6 and the second capacitor C2.

An operation of the falling ramp waveform generating device 42 will be described. First, a ramp control signal generated from the second ramp control signal generating device 46 is applied to the second switching device M2 after a ramp waveform R in the rising interval Ru was applied to the first electrode Y. Such a ramp control signal is inputted, via the ninth resisting device R9 and the second variable resisting device VR2, to the gate electrode of the second switching device M2. At this time, the ramp control signal applied to the second switching device M2 has a slope resulting from resistance values of the second variable resisting device VR2 and the ninth resisting device R9 and a capacitance of the second capacitor C2. In other words, a voltage applied to the gate electrode rises slowly owing to resistances of the first variable resisting device VR1 and the ninth resisting device R9 and a capacitance of the second capacitor C2. Accordingly, a voltage applied from the first electrode Y, via the second switching device M2, to the ground level source GND has a falling slope.

Such a conventional ramp waveform generating device generates a ramp waveform with the aid of resistances of the switching devices M1 and M2. In other words, a channel range of the drain electrode and the source electrode is controlled to generate a ramp waveform. Accordingly, a lot of heats are generated at the conventional switching devices to cause a damage of the switching devices. Furthermore, a ramp waveform voltage source having a voltage value above 400V should be provided so as to uniformly discharge the discharge cells.

SUMMARY OF THE INVENTION

Accordingly, it is an object of the present invention to provide a plasma display panel and a driving method that is capable of generating a sinusoidal initialization waveform.

In order to achieve these and other objects of the invention, a method of driving a plasma display panel according to one aspect of the present invention uses a sinusoidal wave for a formation of wall charges.

In the method, the sinusoidal wave is used as an initialization waveform in an initialization period.

The initialization waveform includes the steps of applying a digital signal corresponding to the sinusoidal wave; converting the digital signal into an analog signal; and amplifying the analog signal.

The sinusoidal wave is generated from a resonance circuit.

At least one of rising and falling sinusoidal wave generated form the resonance circuit is used as the initialization waveform.

When the rising sinusoidal wave is applied to a discharge call, a number of dark discharge are generated with the discharge call to form a wall charge within the discharge call; and when the falling, sinusoidal wave is applied to the discharge call, a number of dark discharges.

The initialization waveform includes the steps of rising until a first voltage at a shape of the sinusoidal wave; and falling from the first voltage at a shape of the sinusoidal wave.

The initialization waveform includes the steps of rising from a ground level until a first voltage at a shape of the sinusoidal wave; being changed into a second voltage different form the first voltage; maintaining the second voltage; and falling from the second voltage at a shape of the sinusoidal wave.

Said initialization waveform includes the steps of rising from a ground level until a first voltage at a shape of said sinusoidal wave; being changed into a second voltage different from the first voltage; maintaining the second voltage; and falling from the second voltage at a shape of said sinusoidal wave.

A voltage value of the second voltage is set to be lower than that of the first voltage.

The initialization waveform includes the steps of rising until a first voltage; maintaining the first voltage; and falling from the first voltage at a shape of the sinusoidal wave.

The initialization waveform includes the steps of rising from ground level until a first voltage; rising from the first voltage until a second voltage at a shape of the sinusoidal wave; being changed into a third voltage different from the second voltage; maintaining the third voltage; and falling form the third voltage at a shape of the sinusoidal wave.

A voltage value of the third voltage is set to be lower than that of the second voltage.

A voltage value of the first voltage is set to be equal to that of the third voltage.

The initialization waveform falls from the third voltage until a ground level at a shape of the sinusoidal wave.

The initialization waveform falls from the third voltage until a negative level at a shape of the sinusoidal wave.

The initialization waveform includes the steps of rising until a first voltage at a shape of the sinusoidal wave; maintaining the first voltage; and falling from the first until a ground level.

A plasma display panel according to another aspect of the present invention includes a plasma display panel having a capacitive load; a voltage source for supplying the panel with a voltage in an initialization period; and an initialization waveform generating device provided between the voltage source and the panel to generate a sinusoidal wave when a voltage is applied from the voltage source.

In the plasma display panel, the initialization waveform generating device includes a controller for supplying a digital signal; a digital to analog converter for converting the digital signal into an analog signal; and an amplifier for amplifying the analog signal.

The initialization waveform generating device includes an inductor for forming a resonance circuit along with the capacitive load.

The plasma display panel further includes a switch provided between the inductor and the voltage source to be turned on in the initialization period.

The plasma display panel further includes a switch provided between the panel and a ground level source to be turned on when the capacitive load is initialized.

The plasma display panel further includes a diode provided between the switch and the inductor to prevent a current from the capacitive load from being applied to the switch.

A plasma display panel according to still another aspect of the present invention includes a plasma display panel having a capacitive load; a voltage source for supplying the panel with a voltage in an initialization period; external drivers for applying a scan pulse, a sustain pulse and an erase pulse to the panel; an initialization waveform generating device for causing a resonance along with the capacitive load to apply an initialization waveform to the panel; and an isolating device provided between the initialization waveform generating device and the external drivers to electrically separate the initialization waveform generating device from the external drivers.

The isolating device includes at least one switch.

The isolating device includes a voltage source; a first switch provided between the voltage source and the isolating device; an inductor arranged between the first switch and the isolating device to provide a resonance with the capacitive load when a voltage is supplied from the voltage source, and second and third switches provided between each end of the inductor and a ground level source.

The plasma display panel further includes a diode provided between the first switch and the inductor to prevent a backward current.

The isolating device includes first and second switches connected, in parallel, between the initialization waveform generating device and the external drivers; a first diode connected to the first switch to apply a current from the initialization waveform generating device to the capacitive load; and a second diode connected to the second switch to apply a current from the capacitive load to the initialization waveform generating device.

When the first switch is turned on, the initialization waveform with a rising slope is applied to the panel.

The rising slope of the initialization waveform is determined by an inductance of the inductor.

The initialization waveform has a first rising slope when the inductance of the inductor has a first value while having a second rising slope gender than the first rising slope when the inductance has a second value larger than the first value.

When the second switch is turned on, a voltage charged in the capacitive load is applied to the ground level source at a falling slope.

The falling slope of the initialization waveform is determined by an inductance of the inductor.

The initialization waveform has a first falling slope when the inductance of the inductor has a first value while having a second falling slope gender than the first falling slope when the inductance has a second value larger than the first value.

When the third switch is turned on, the inductor is initialized.

The plasma display panel further includes an initialization waveform modifying device provided between the isolating device and the external drivers to control a falling start voltage of said initialization waveform.

The initialization waveform modifying device includes a modifying voltage source; a first switch provided between the modifying voltage source and the capacitive load; and a second switch provided between the capacitive load and the ground level source.

When the second switch is turned on, the capacitive load is initialized.

A voltage value of the modifying voltage source is set to be different from a peak value of the initialization waveform.

A voltage value of the modifying voltage source is set to be lower than a peak value of the initialization waveform.

The first switch is turned on such that a voltage of the capacitive load becomes equal to a voltage value of the modifying voltage source after a voltage was charged in the capacitive load.

The initialization waveform generating device includes a first voltage source; a first switch provided between the first voltage source and the isolating device; an inductor provided between the first switch and the isolating device to provide a resonance along with the capacitive load when a voltage is applied thereto; a second voltage source connected inductor; and a second switch provided between the second voltage source and the inductor.

The plasma display panel further includes a diode provided between the first switch and the first voltage source to pass a current flowing toward the first voltage source.

The plasma display panel further includes a diode provided between the second switch and the inductor to pass a current flowing toward the inductor.

The plasma display panel further includes third and fourth switches provided between each end of the inductor and the ground level source to be turned on when the inductor is initialized.

The plasma display panel further includes an initialization waveform modifying device provided between the isolating device and the external drivers to control rising and falling start voltages of the initialization waveform diagram.

The initialization waveform generating device includes a third switch provided between the third voltage source and the capacitive load; a fourth switch provided between the fourth voltage source and capacitive load; and a fifth switch provided between the ground level source and the capacitive load.

A voltage from the third voltage source is applied to the capacitive load when the third switch is turned on and the second switch is turned on after the voltage from the third voltage source is charged in the capacitive load, thereby applying an initialization waveform with a rising slope to the capacitive load.

The rising slope of the initialization waveform is determined by an inductance of the inductor.

The initialization waveform has a first rising slope when the inductance of the inductor has a first value while having a second rising slope gender than the first rising slope when the inductance has a second value larger than the first value.

A voltage of the initialization waveform applied to the capacitive load is set to a voltage obtained by subtracting the third voltage from twice the voltage of the second voltage source.

After a voltage was charged in the capacitive load, the fourth switch is turned on to thereby convert of the capacitive load into a voltage value of the fourth voltage source.

A voltage value of the fourth voltage source is set to be lower than a peak value of the initialization waveform.

The first switch is turned on after voltage of the capacitive load was changed into the voltage value of the fourth voltage source, thereby applying an initialization waveform with a falling slope to the capacitive load.

The falling slope of the initialization waveform is determined by an inductance of the inductor.

The initialization waveform has a first falling slope when the inductance of the inductor has a first value while having a second falling slope gender than the first falling slope when the inductance has a second value larger than the first value.

A voltage value of the first voltage source is set to be different from that of the fourth voltage source.

A voltage value of the first voltage source is set to be a half the voltage of the fourth voltage source.

A voltage value of the first voltage source is set to be lower than a half the voltage of the fourth voltage source.

When the fifth switch is turned on, the capacitive load is initialized.

A plasma display panel according to still another aspect of the present invention includes a plasma display panel having a capacitive load; a first voltage source for supplying the panel with a voltage in an initialization period; an inductor connected to the capacitive load to apply the panel to a sinusoidal wave; and a second voltage source connected, via the inductor, to the capacitive load to determine an amplitude of the sinusoidal wave.

The plasma display panel further includes a switch provided between the first voltage source and the capacitive load.

The plasma display panel further includes a switch provided between the second voltage source and the inductor to be turned on when a voltage charged in the capacitive load is discharged.

A voltage value of the second voltage source is set to be a half the first voltage source.

The plasma display further includes a switch provided between the panel and a ground level source to be turned on when the capacitive load is initialized.

A plasma display panel according to still another aspect of the present invention incluldes means for generating a sinusoidel wave; and a plurality of cell for the forming wall change in response to the sinusoidal wave.

A plasma display panel according to still another aspect of the invention includes a voltage source; a plasma display panel; an inductor connected between the panel and the voltage source; and a switch provided between the inductor and the voltage source; the switch being driven to form wall charge at the panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
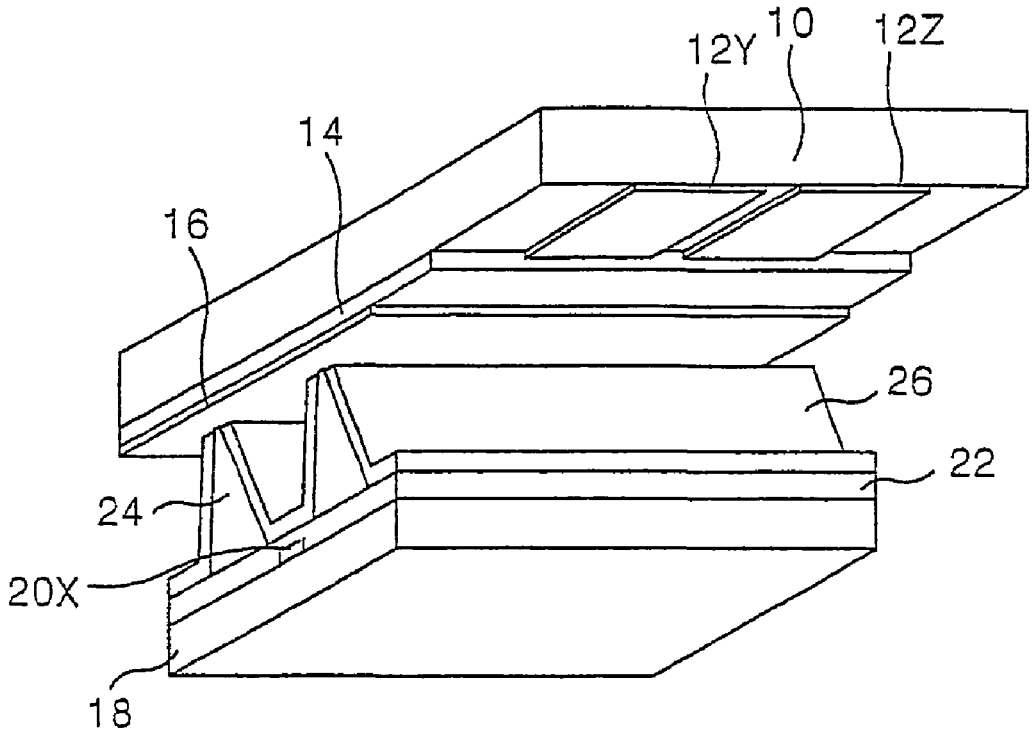
FIG. 1 PRIOR ART
FIG. 1 is a perspective view showing a discharge cell structure of a conventional AC surface-discharge plasma display panel.
Figure 2:
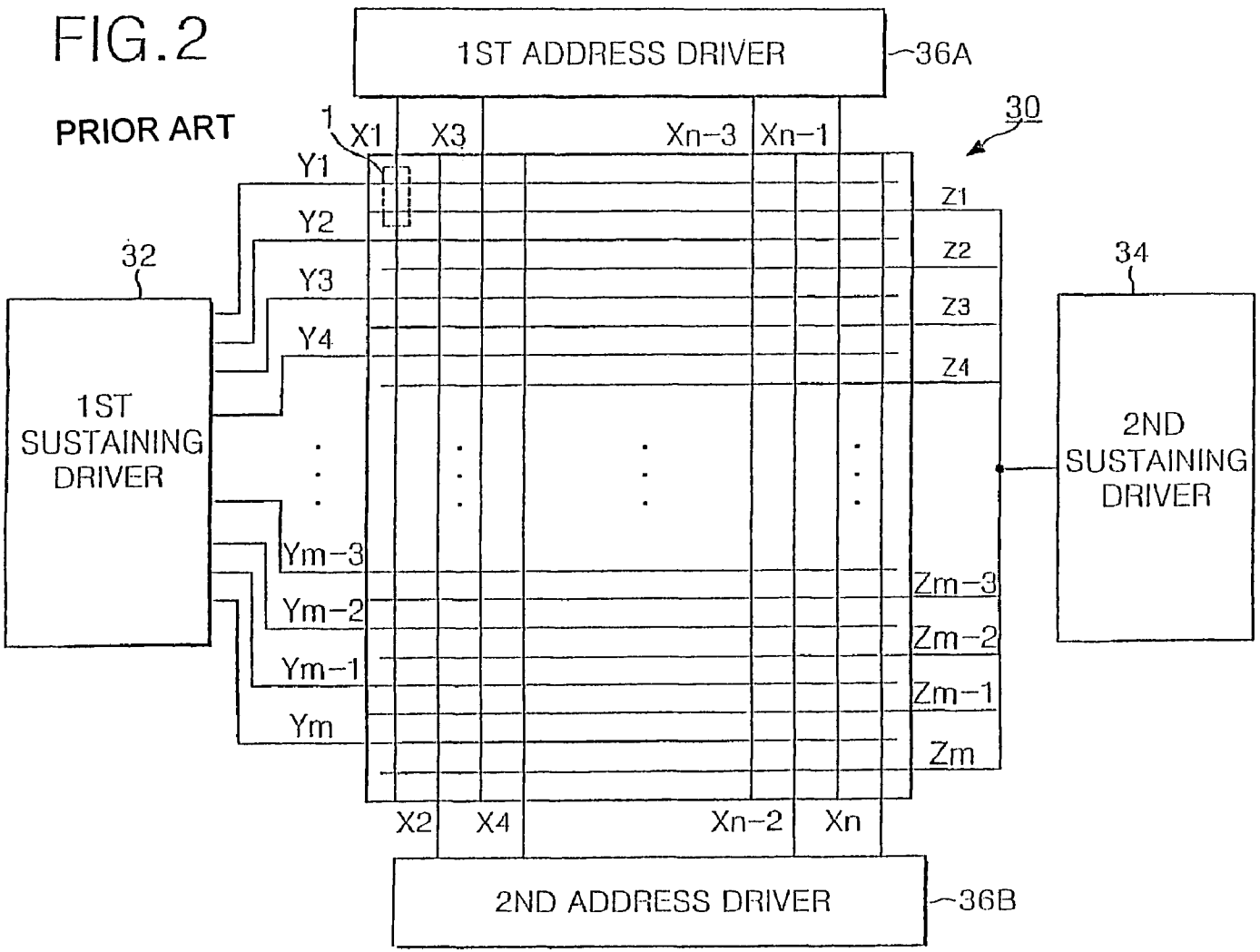
FIG.2 PRIOR ART
FIG. 2 is a plan view showing an arrangement of entire electrode lines and discharge cells of the plasma display panel in FIG. 1.
Figure 3:
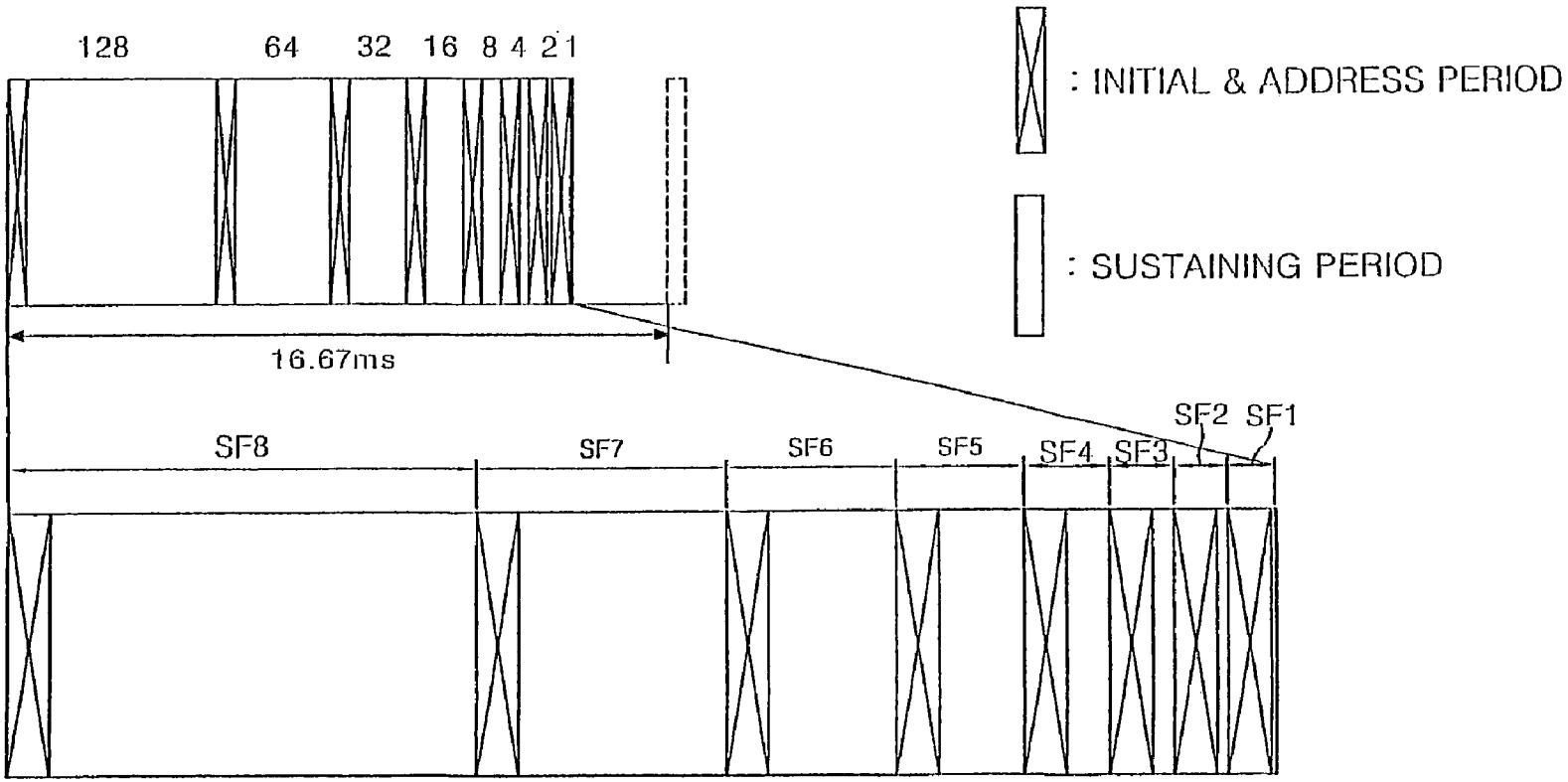
FIG. 3 PRIOR ART
FIG. 3 illustrates one frame gray level of the plasma display panel in FIG. 1.
Figure 4:
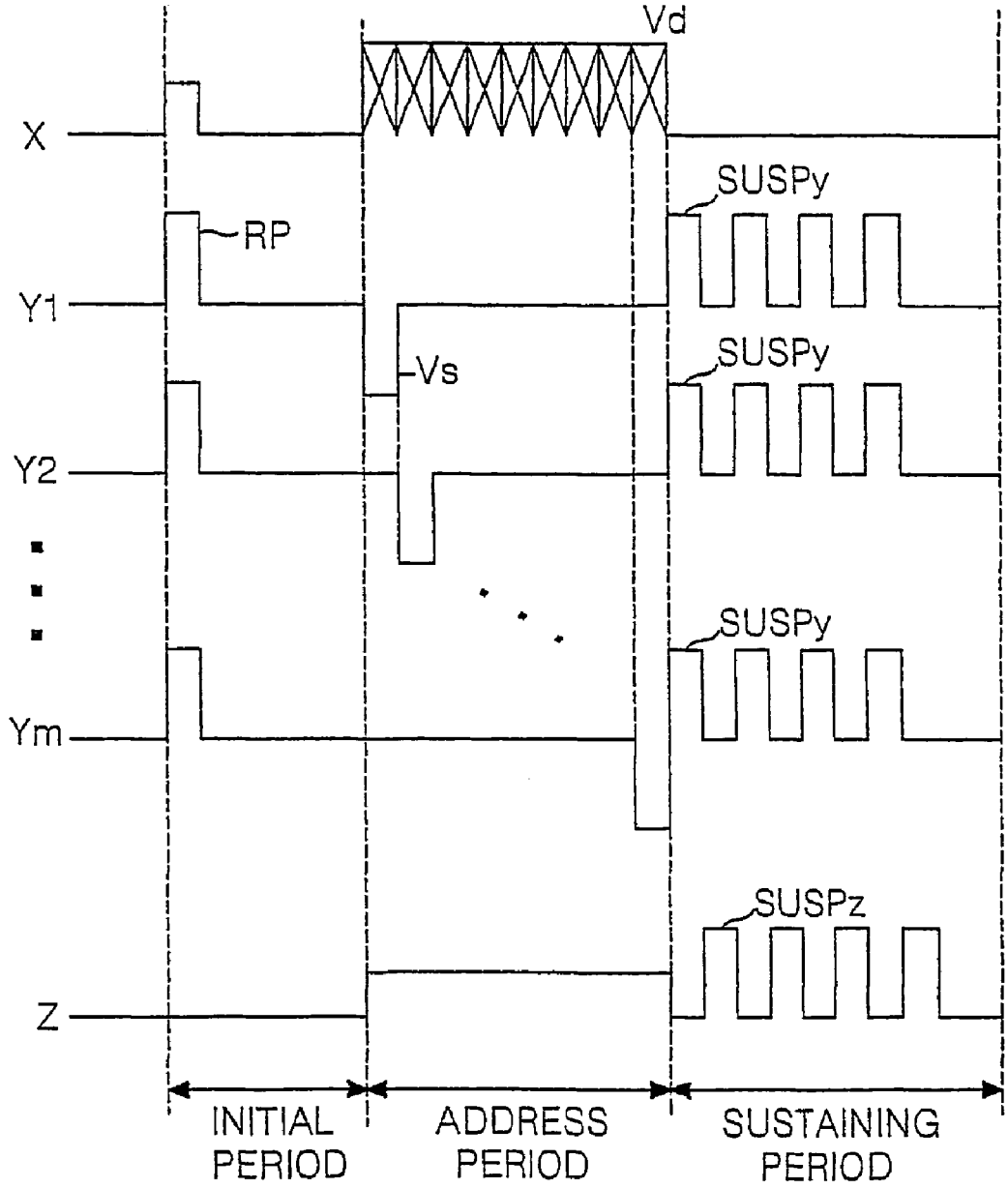
FIG. 4 PRIOR ART
FIG. 4 illustrates a driving waveform applied to each electrode of the plasma display panel for each sub-field.
Figure 5:
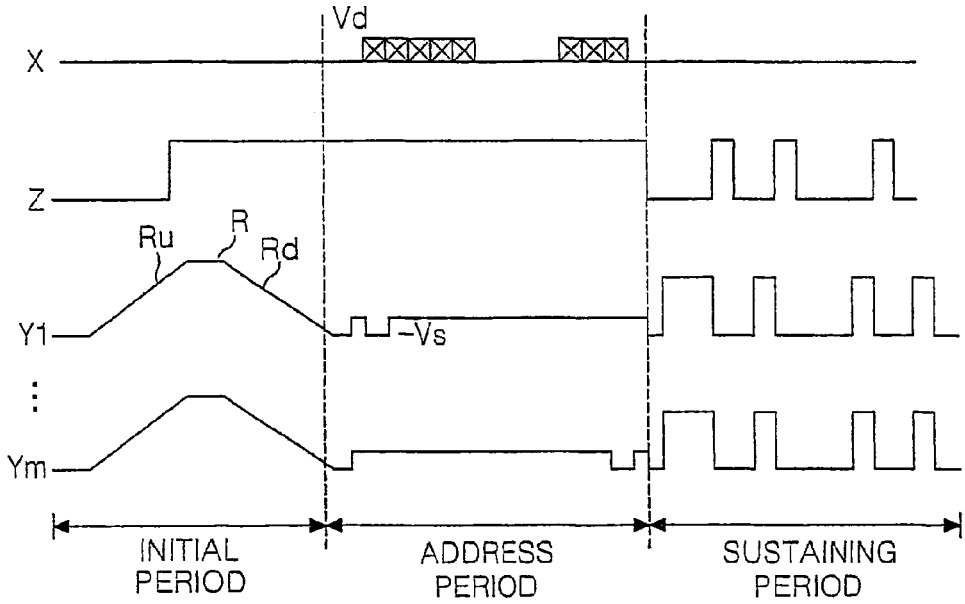
FIG.5 PRIOR ART
FIG. 5 is a waveform diagram for explaining a method of driving the plasma display panel to which a lamp waveform is applied in the initialization period.
Figure 6:
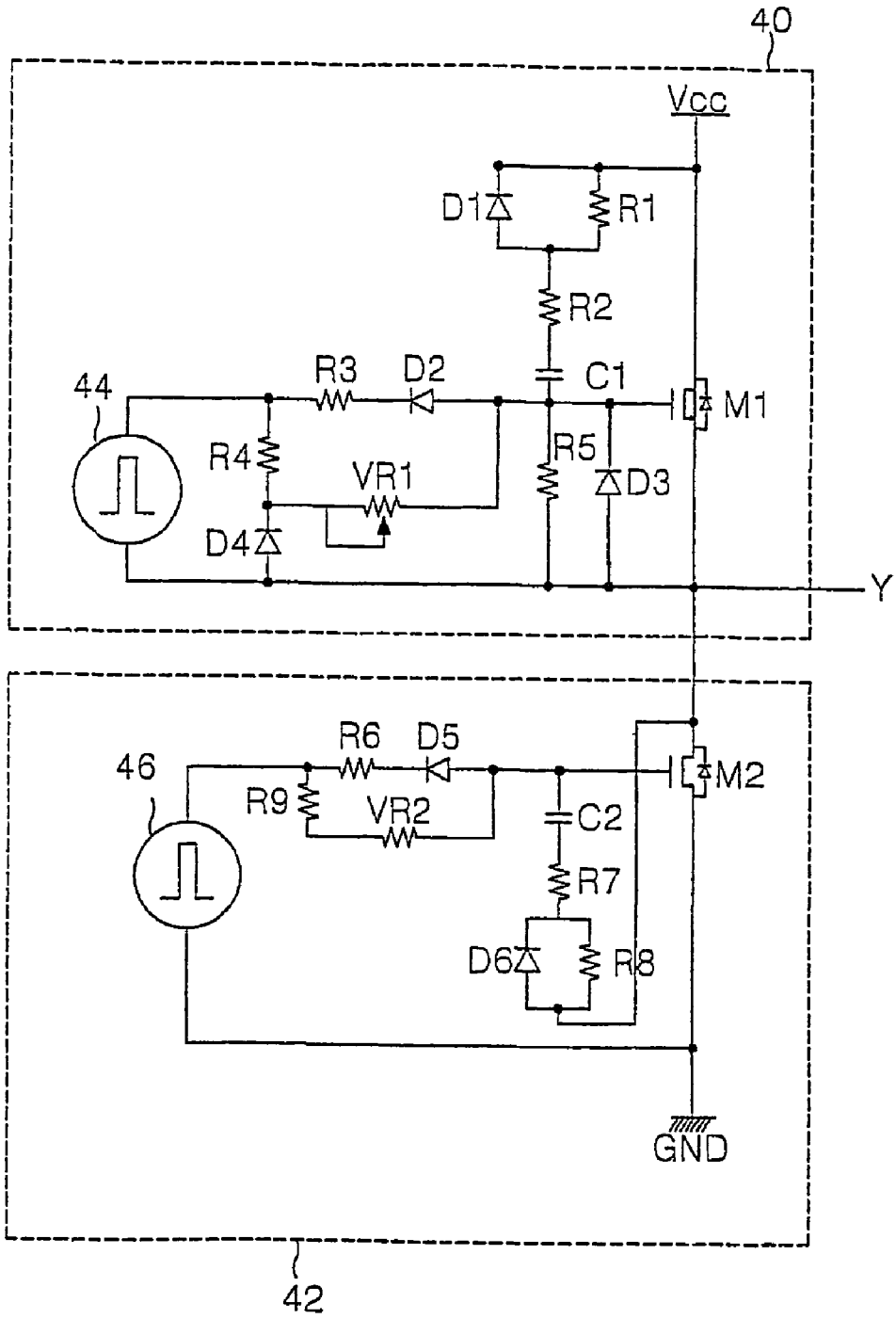
FIG. 6 PRIOR ART
FIG. 6 is a circuit diagram of a ramp waveform generating device for generating the ramp waveform shown in FIG. 5.
Figure 7:
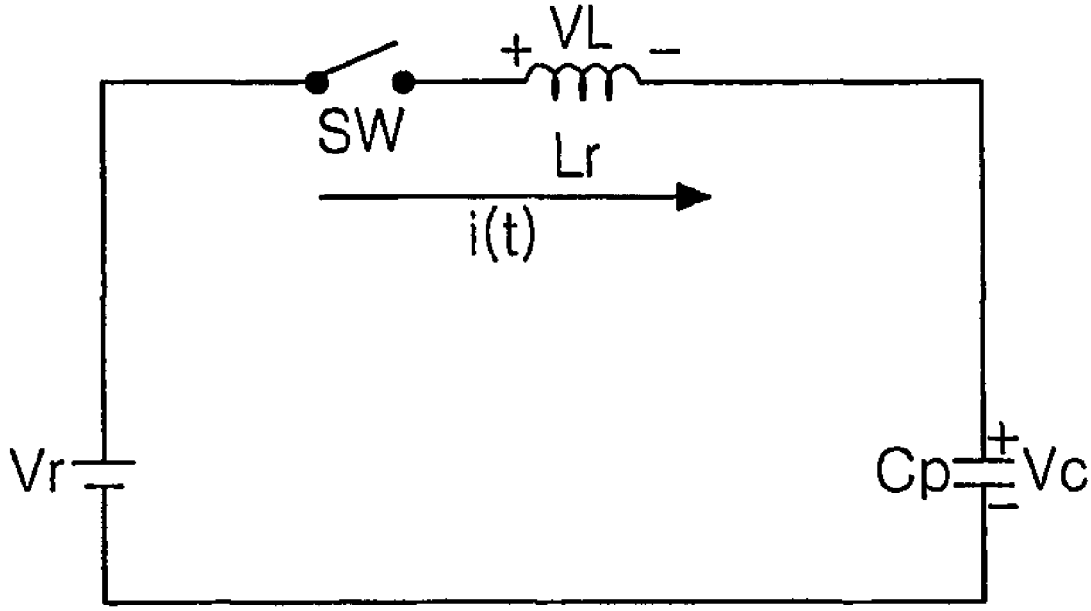
FIG. 7 is a circuit diagram for explaining a principle of a resonance circuit.

FIG. 7 is a circuit diagram for explaining a principle of a resonance circuit according to the present invention.

Referring to FIG. 7, the resonance circuit includes a voltage source Vr and a capacitor Cp, a switch SW and an inductor Lr connected, in series, between the voltage source Vr and the capacitor Cp. The voltage source Vr supplies the inductor Lr and the capacitor Cp with a predetermined voltage when the switch SW is turned on. The switch SW is turned on or off to determine a supply time of a voltage. The inductor Lr and the capacitor Cp forms a resonance circuit, i.e., a LC resonance circuit when a voltage is supplied from the voltage source Vr.

A voltage applied to the inductor Lr and the capacitor Cp by turning-on of the switch SW is determined by the following equation:

$$Lr(di/dt)+(1/Cp)\int idt=Vru(t) \quad (1)$$

A Laplace's transformation is applied to the above equation (1) to derive the following equation:

$$Lr[sI(s)-i_{(0+)}]+(1/Cp)[I(s)/s+q_{(0+)}/s]=Vr/s \quad (2)$$

If the above equation (2) is replaced by $i_{(0+)}=0$ and $q_{(0+)}=0$ to satisfy an initial condition, then the following equation (3) is derived.

$$I(s)=\{Vr\sqrt{(CpLr)}/Lr\}*[1/\sqrt{(CpLr)}/[s^2+\{1/\sqrt{(CpLr)}\}^2]] \quad (3)$$

The above equation (3) is subject to a reverse transform to derive the following equation:

$$i(t)=Vr\sqrt{\{(Cp/Lr)S\}}*\sin\{1/\sqrt{(CpLr)}t\} \quad (4)$$

A voltage $V_L$ applied to the inductor Lr is derived from the above equations (3) and (4) as expressed by the following equation:

$$V_L=Lr(di/dt)=Vr*\cos\{1/\sqrt{(CpLr)}t\} \quad (5)$$

A voltage $V_C$ applied to the capacitor Cp is derived from the above equations (3) and (4) as expressed by the following equation:

$$V_C=Vr-V_L=Vr-Vr\cos\{1/\sqrt{(CpLr)}t\} \quad (6)$$

From the above equations, a period of the resonance circuit becomes $2\pi\sqrt{(LrCp)}$ and a time required for applying a maximum voltage 2Vr to the capacitor Cp becomes $\pi\sqrt{(LrCp)}$.

Figure 8:
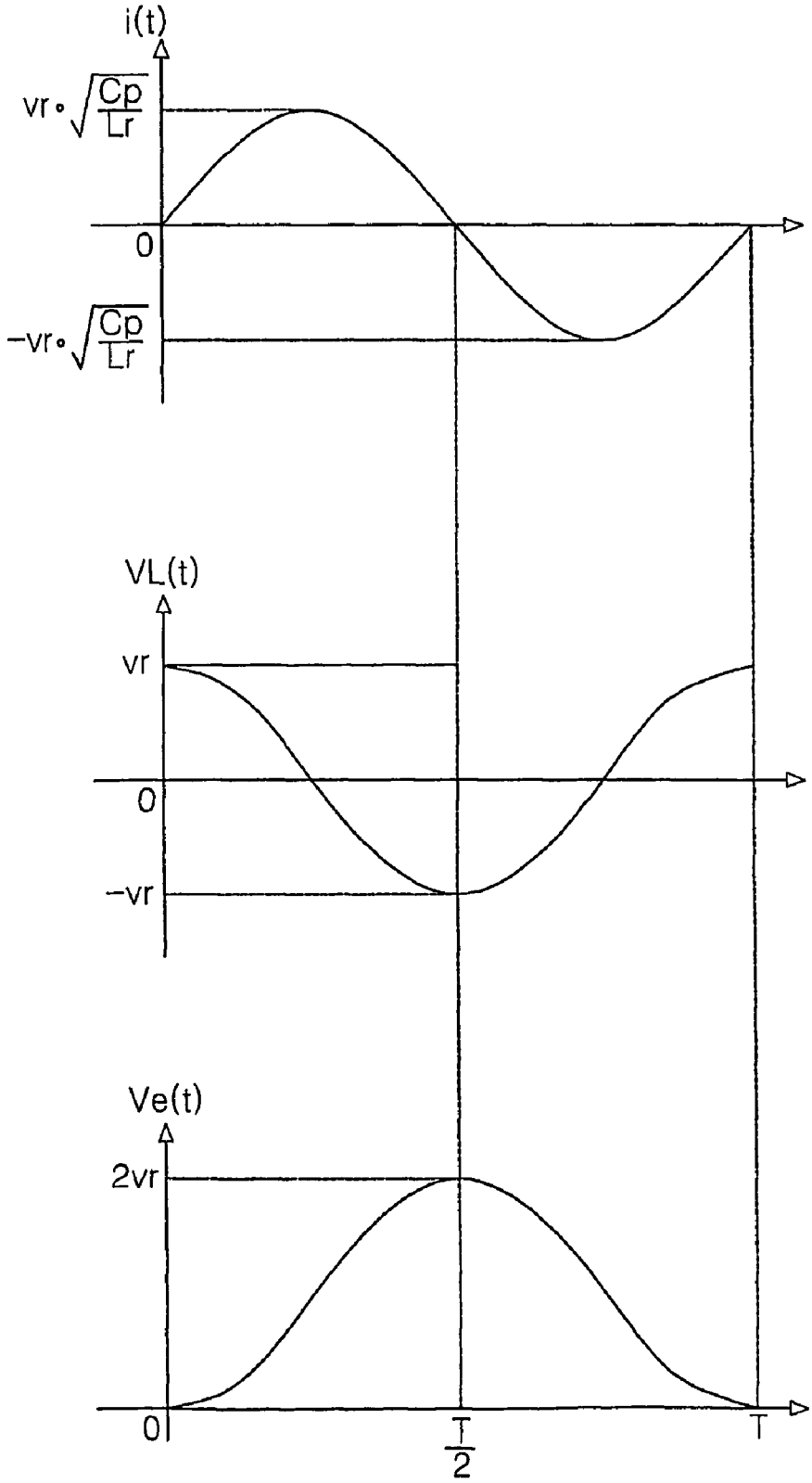
FIG. 8 is a waveform diagram of a current/voltage of the inductor and the capacitor shown in FIG. 7.

FIG. 8 illustrates voltage and current waveforms as expressed by the equations (4) to (6). Herein, the capacitor Cp is assumed to be an equivalent circuit of a discharge cell.

Referring to FIG. 8, when t=T/2, a peak-to-peak voltage is charged in the capacitor Cp by a resonance of the capacitor Cp and the inductor Lr. At this time, twice voltage 2Vr of the voltage source Vr is charged in the capacitor Cp. Meanwhile, a voltage charged in the capacitor Cp has a maximum slope at a period of t=T/4 while having a minimum slope at a period of t=3T/4. In the present invention, a dark discharge is generated within the discharge cell with the aid of a rising sinusoidal wave, and it causes a wall charge to be formed within the discharge cell. Further, a wall charge amount within the cell is reduced by a dark discharge generated upon application of a falling sinusoidal wave, and a final wall charge amount is uniformed between all the discharge cells.

Figure 9A:
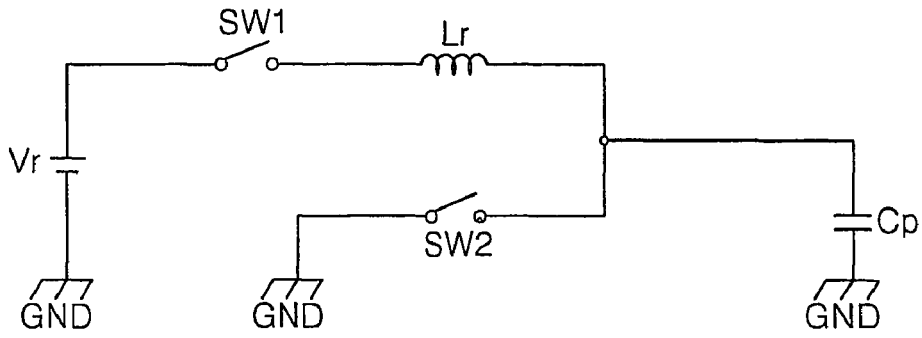
FIG. 9A and FIG. 9B are a circuit diagram and an output waveform diagram of an initialization waveform generating device according to a first embodiment of the present invention, respectively.

FIG. 9A shows an initialization waveform generating device according to a first embodiment of the present invention.

Referring to FIG. 9A, the initialization waveform generating device includes a capacitor Cp and an initializing voltage source Vr, a first switch SW1 and an inductor Lr connected, in series, between the capacitor Cp and the initializing voltage source Vr, and a second switch SW2 arranged between the capacitor Cp and a ground level source GND.

The capacitor Cp is an equivalent expression of the discharge cell. The initializing voltage source Vr applies a predetermined voltage, via the inductor Lr, to the capacitor Cp (i.e., a first electrode Y) when the first switch SW1 is turned on. The inductor Lr causes a resonance along with the capacitor Cp when a voltage from the initializing voltage source Vr is applied to the capacitor Cp such that a voltage 2Vr equal to twice the initializing voltage source Vr can be supplied to the capacitor Cp.

Figure 9B:
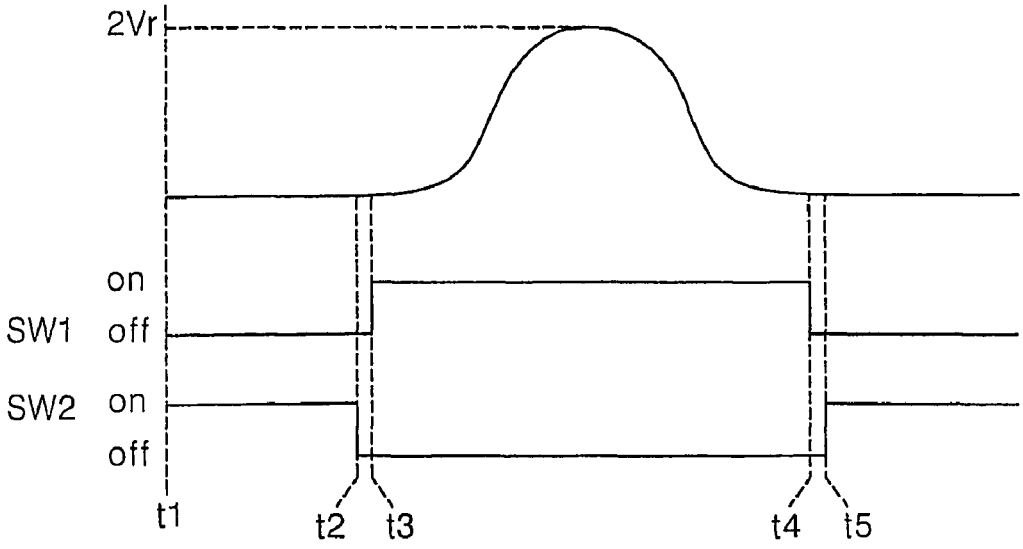

An operation of the initialization waveform generating device will be described with reference to FIG. 9B below.

First, at a time t1, the second switch SW2 is turned on. If the second switch SW2 is turned on, then the capacitor Cp is connected to the ground level source GND to be initialized. After such an initialization of the capacitor Cp, the second switch SW2 is turned off at a time t2.

Subsequently, the first switch SW1 is turned on at a time t3. If the first switch SW1 is turned on, then a voltage from the initializing voltage source Vr is applied to the inductor Lr and the capacitor Cp. At this time, the inductor Lr and the capacitor Cp form a resonance circuit. Accordingly, a rising or falling voltage of 2Vr is applied to the capacitor Cp.

Meanwhile, when such a voltage of 2Vr is fed to the discharge cells (i.e., capacitors Cp), the discharge cells generate a number of dark discharges, which causes a wall charge to be formed within the discharge cells. Further, when a voltage falls within the discharge cells, the dark discharges reduce a wall charge amount within the cells to thereby uniform a final wall charge amount between all the discharge cells.

After a uniform wall charge was formed at the discharge cell, the first switch SW1 is turned off at a time t4. In turn, the second switch SW2 is turned on at a time t5 to initialize the discharge cell. The initialization waveform generating device according to the first embodiment repeats a process at t1 to t5 to produce a wall charge at the discharge cells. Such an initialization waveform generating device according to the first embodiment is applicable to a PDP adopting a selective writing system.

Figure 10A:
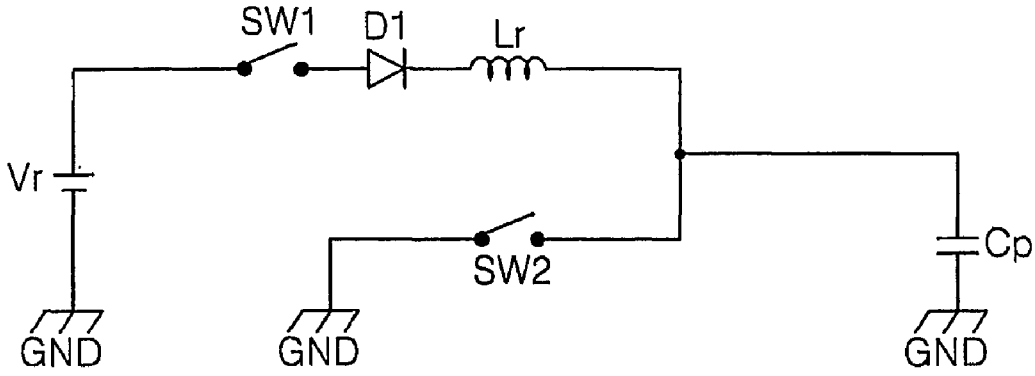
FIG. 10A and FIG. 10B are a circuit diagram and an output waveform diagram of an initialization waveform generating device according to a second embodiment of the present invention, respectively.

FIG. 10A shows an initialization waveform generating device according to a second embodiment of the present invention.

Referring to FIG. 10A, the initialization waveform generating device includes a capacitor Cp and an initializing voltage source Vr, a serial connection of a first switch SW1, a diode D1 and an inductor Lr provided between the capacitor Cp and the initializing voltage source Vr, and a second switch SW2 arranged between the capacitor Cp and a ground level source GND.

The capacitor Cp is an equivalent expression of the discharge cell. The initializing voltage source Vr applies a predetermined voltage, via the inductor Lr, to the capacitor Cp when the first switch SW1 is turned on. The inductor Lr causes a resonance along with the capacitor Cp when a voltage from the initializing voltage source Vr is applied to the capacitor Cp such that a voltage 2Vr equal to twice the initializing voltage source Vr can be supplied to the capacitor Cp. The diode D1 controls a current flow to prevent a falling slope of waveform from being applied to the capacitor Cp.

Figure 10B:
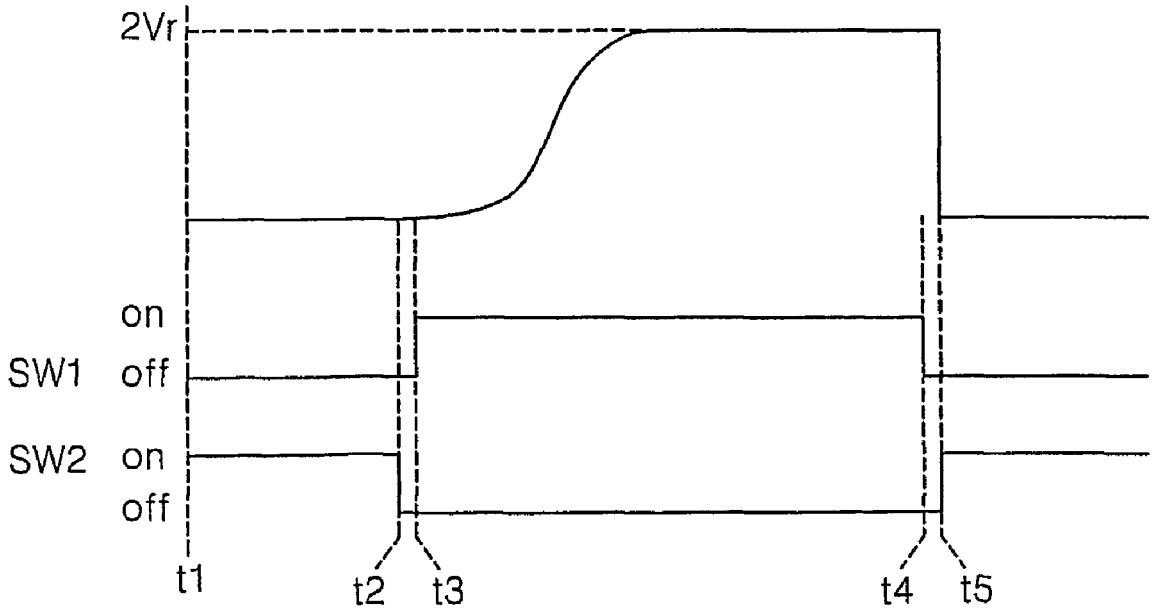

An operation of the initialization waveform generating device will be described with reference to FIG. 10B below.

First, at a time t1, the second switch SW2 is turned on. If the second switch SW2 is turned on, then the capacitor Cp is initialized. After such an initialization of the capacitor Cp, the second switch SW2 is turned off at a time t2.

Subsequently, the first switch SW1 is turned on at a time t3. If the first switch SW1 is turned on, then a voltage from the initializing voltage source Vr is applied to the inductor Lr and the capacitor Cp. At this time, a voltage of 2Vr with a rising slope is applied to the capacitor Cp by a resonance of the inductor Lr and the capacitor Cp. After a voltage of 2Vr was fed to the capacitor Cp, the capacitor Cp maintains the voltage of 2Vr during a predetermined time interval (i.e., a time interval until turning-on of the second switch SW2).

Thereafter, the first switch SW1 is turned off at a time t4 and the second switch SW2 is turned on at a time t5. If the second switch SW2 is turned on, then a voltage having charged in the capacitor Cp is discharged into the ground level source GND.

In such an initialization waveform generating device according to the second embodiment, a voltage fed to the capacitor Cp does not drop owing to the diode D1 after a voltage of 2Vr was applied to the capacitor Cp. In other words, the diode D1 prevents a generation of falling sinusoidal wave. If a falling sinusoidal wave does not occur, then a wall charge produced at the discharge cell is not erased. Accordingly, such an initialization waveform generating device according to the second embodiment is applicable to a PDP adopting a selective erasing system.

Figure 11:
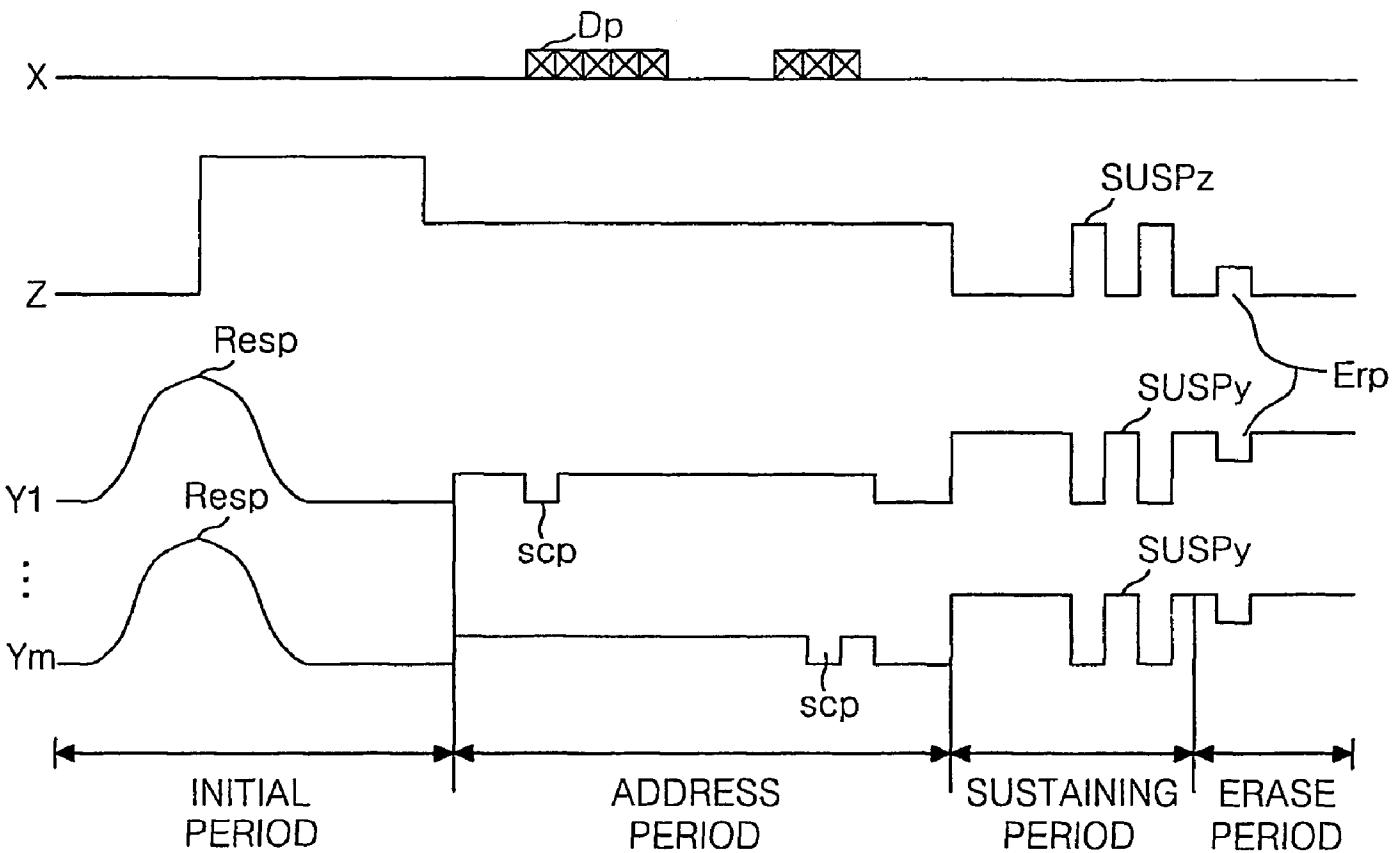
FIG. 11 is a waveform diagram for explaining a method of driving the plasma display panel employing the initialization waveform according to the first embodiment of the present invention.

FIG. 11 is a waveform diagram for explaining a method of driving a plasma display panel employing the initialization waveform generating device according to the first embodiment of the present invention.

Referring to FIG. 11, the PDP driving process is divided into an initialization period for initializing the entire field, an address period for scanning the entire field on a line sequence basis to write a data, a sustain period for sustaining light-emission states of the cells into which a data has been written, and an erase period for erasing a sustaining emission.

First, in the initialization period, a sinusoidal wave Resp with rising and falling slopes is applied from the initialization waveform generating device according to the first embodiment of the present invention. A voltage slowly rises at the rising edge of the sinusoidal wave Resp to generate a dark discharge within the discharge cell. This dark discharge causes a wall charge to be formed within the discharge cell. Meanwhile, a voltage falling slowly at the falling edge of the sinusoidal wave Resp generates a dark discharge, which reduces a wall charge amount within the cell and uniforms a wall charge amount between the discharge cells.

In the address period, a scan pulse Scp is sequentially applied to the first electrodes Y. Also, a data pulse Dp synchronized with the scan pulse Scp is applied to the address electrodes D. At this time, an address discharge occurs at the discharge cells to which the data pulse Dp and the scan pulse Scp have been applied.

In the sustain period, first and second sustain pulses SUSPy and SUSPz are alternately applied to the first electrodes Y and the second electrodes Z to cause a sustain discharge at the discharge cells where the address discharge has been generated.

In the erase period, an erasure pulse Erp is applied to the first electrodes Y and the second electrodes Z. If the erasure pulse Erp is applied to the first electrodes Y and the second electrodes Z, then the sustain discharge having been generated in the sustain period is erased.

Figure 12A:
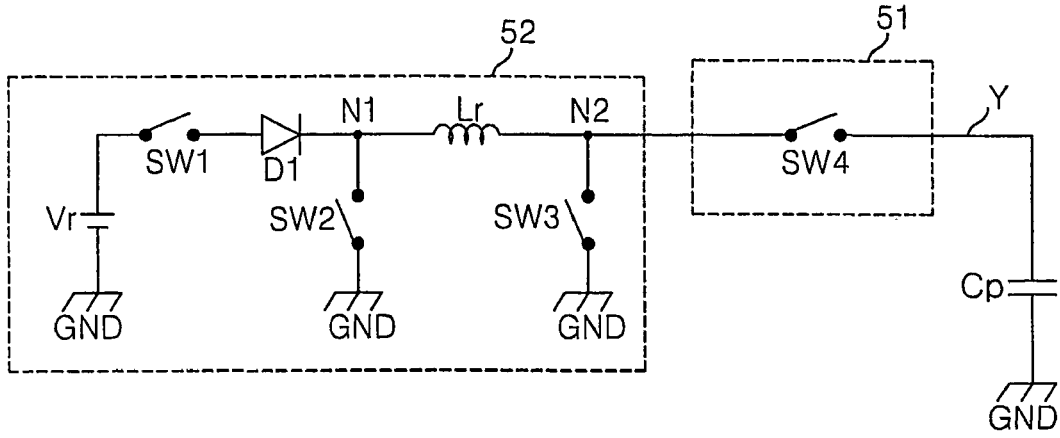
FIG. 12A and FIG. 12B are circuit diagrams of an initialization waveform generating device according to a third embodiment of the present invention.

FIG. 12A shows an initialization waveform generating device according to a third embodiment of the present invention.

Referring to FIG. 12A, the initialization waveform generating device includes an initialization waveform generating unit 52 for generating an initialization waveform, and an isolating unit 51 provided between the initialization waveform generating unit 52 and a first electrode Y to isolate the initialization waveform generating unit 52 from the first electrode Y. The capacitor Cp is an equivalent expression of the discharge cell.

The initialization waveform generating device 52 includes an initializing voltage source Vr, a serial connection of a first switch SW1, a first diode D1 and an inductor Lr provided between the initializing voltage source Vr and an isolating device 50, a second switch SW2 provided between a first node N1 and a ground level source GND, and a third switch SW3 provided between a second node N2 and the ground level source GND.

The first switch SW1 is turned on when an initialization waveform is applied to a first electrode Y. In other words, when the first switch SW1 is turned on, a voltage from the initializing voltage source Vr is applied to the inductor Lr. The second switch SW2 is turned on in the falling edge of the initialization waveform. The third switch SW3 is turned on to initialize the inductor Lr. The first diode D1 is provided to prevent a backward current.

An external driver for generating a scan pulse Scp, a sustain pulse SUSPy and an erase pulse Erp, etc. is provided between the initialization waveform generating device 52 and the first electrode Y. The isolating device 51 is provided to isolate the external driver from the initialization waveform generating device 52. In other words, the isolating device 51 prevents the initialization waveform from being distorted due to a direct connection between the external driver and the initialization waveform generating device 52.

Such an isolating device 51 includes a fourth switching device SW4. The fourth switching device SW4 is turned on when an initialization waveform from the initialization waveform generating device 52 is applied to the first electrode Y. Alternatively, the isolating device 51 may be configured as shown in FIG. 12B.

Figure 12B:
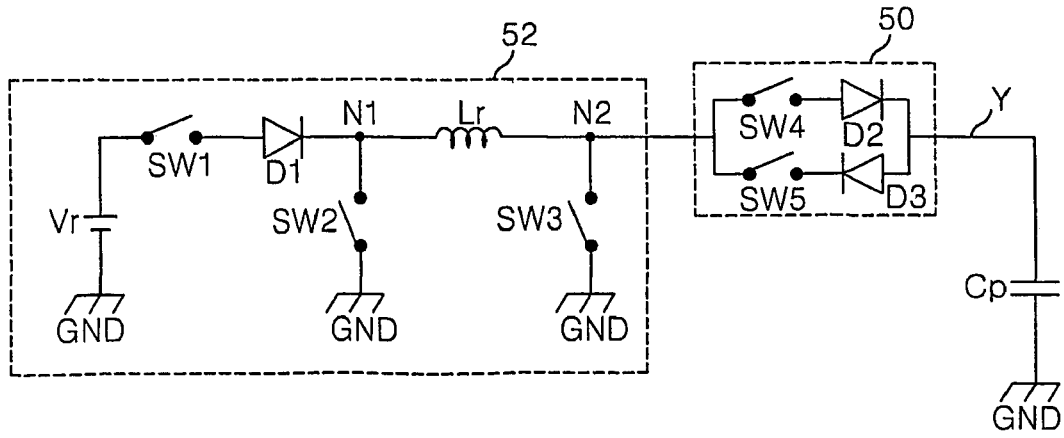

The isolating device 50 shown in FIG. 12B includes a fourth switch SW4 and a second diode D2 provided between the initialization waveform generating device 52 and the first electrode Y, and a fifth switch SW5 and a third diode D3 connected, in parallel, to the fourth switch SW4 and the second diode D2. The second diode D2 and the third diode D3 are provided such that a current passes at a direction contrary to each other.

Figure 13:
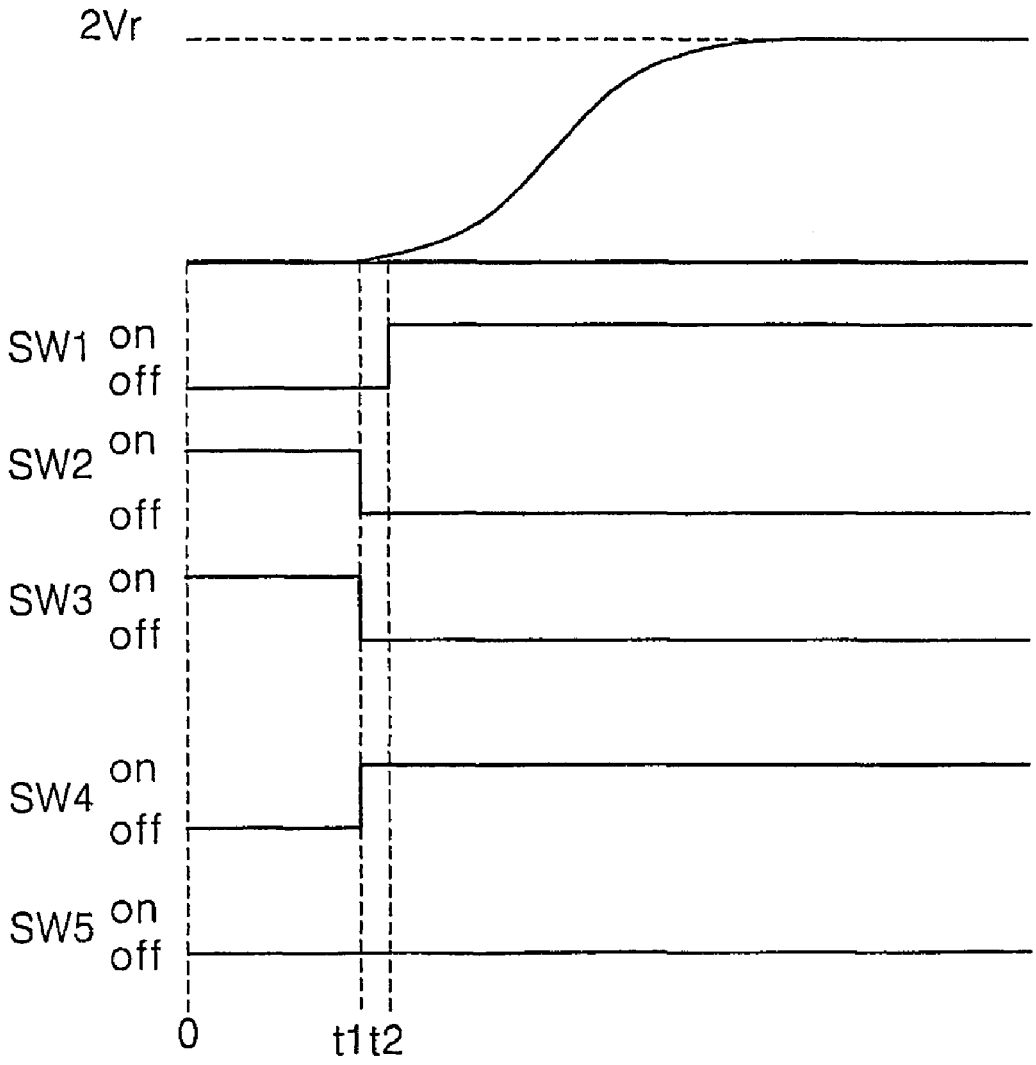
FIG. 13 illustrates a rising edge of the initialization waveform generated from the initialization waveform generating device shown in FIG. 12.

A procedure of generating a rising waveform from the initialization waveform generating device will be described in detail with reference to FIG. 12B and FIG. 13.

First, the second switch SW2 and the third switch SW3 are turned on to thereby initialize the inductor Lr. After such an initialization of the inductor Lr, at a time t1, the second and third switches SW2 and SW3 are turned off while the fourth switch SW4 is turned on. If the fourth switch SW4 is turned on, then the inductor Lr is electrically connected to a panel capacitor Cp.

After turning-on of the fourth switch SW4, the first switch SW1 is turned on at a time t2. If the first switch SW1 is turned on, then the initializing voltage source Vr, the inductor Lr and the panel capacitor Cp are electrically connected to each other. Thus, when the first switch SW1 is turned on, a resonance waveform (i.e., an initialization waveform) having a slope as shown in FIG. 13 is applied to the first electrodes Y owing to a resonance of the inductor Lr and the panel capacitor Cp. At this time, owing to such a resonance, a voltage equal to twice the initializing voltage source Vr is applied to the capacitor Cp. Such an initialization waveform is applied to the first electrode Y during a predetermined time. The slope of the initialization waveform can be controlled by an adjustment of an inductance value of the inductor Lr.

Figure 14:
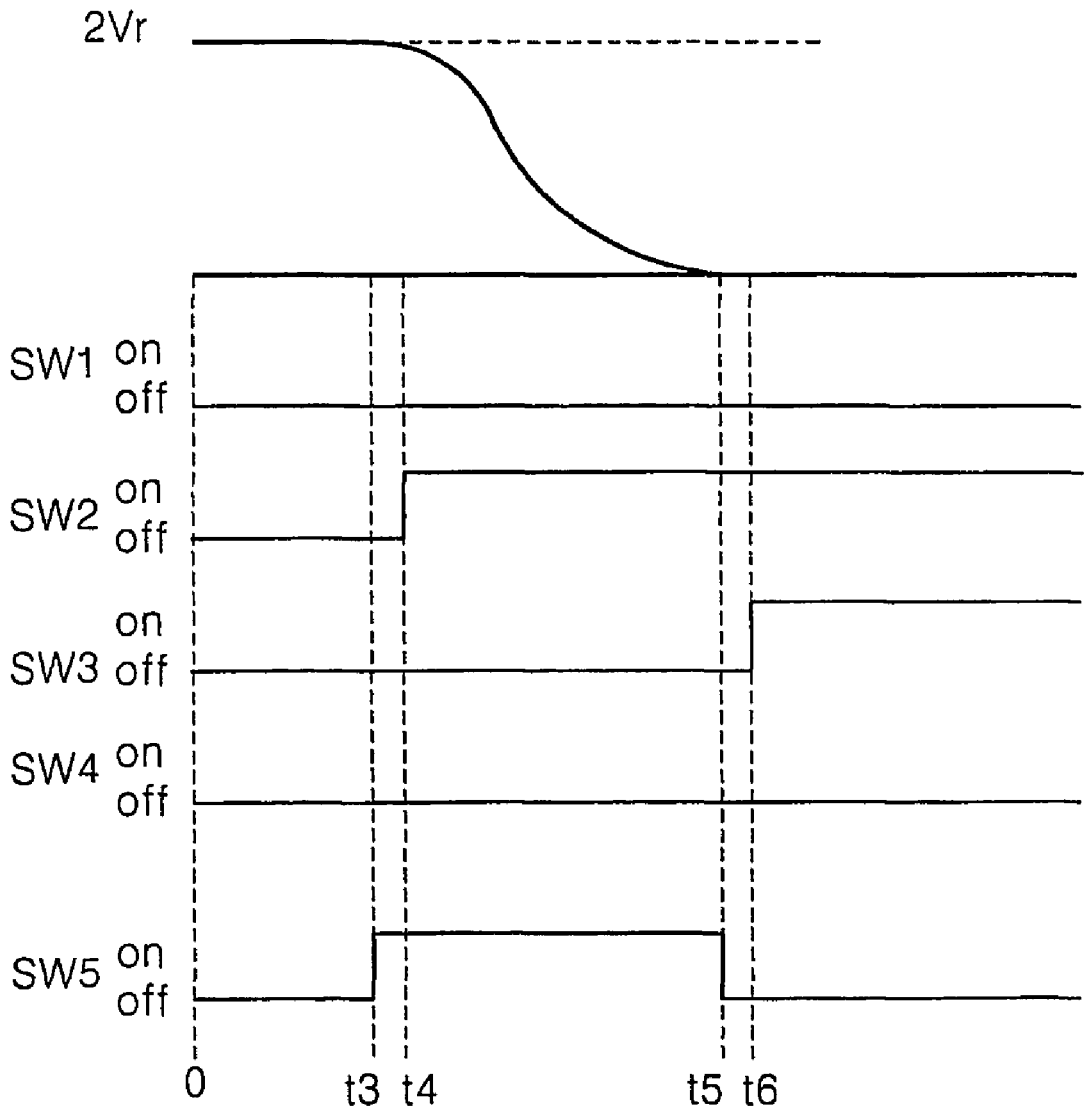
FIG. 14 illustrates a falling edge of the initialization waveform generated from the initialization waveform generating device shown in FIG. 12.

A procedure of generating a falling waveform from the initialization waveform generating device will be described in detail with reference to FIG. 12B and FIG. 14.

First, the fifth switch SW5 is turned on at a time t3. If the fifth switch SW5 is turned on, then the panel capacitor Cp is electrically connected to the inductor Lr. At a time t4, the second switch SW2 is turned on.

If the second switch SW2 is turned on, the ground level source GND, the inductor Lr and the panel capacitor Cp are electrically connected to each other. In other words, a voltage charged in the panel capacitor Cp is applied, via the inductor Lr, to the ground level source GND. At this time, a resonance waveform (i.e., an initialization waveform) having a falling slope as shown in FIG. 14 is applied to the first electrodes Y owing to a resonance of the inductor Lr and the panel capacitor Cp. The slope of the initialization waveform can be controlled by an adjustment of an inductance value of the inductor Lr.

After discharge of the voltage charged in the panel capacitor Cp, the fifth switch SW5 is turned off. At a time t6, the third switch SW3 is turned on to thereby initialize the inductor Lr. According to the present embodiments, various types of initialization waveforms can be produced by an operation of the switch in the initialization waveform generating device.

Figure 15:
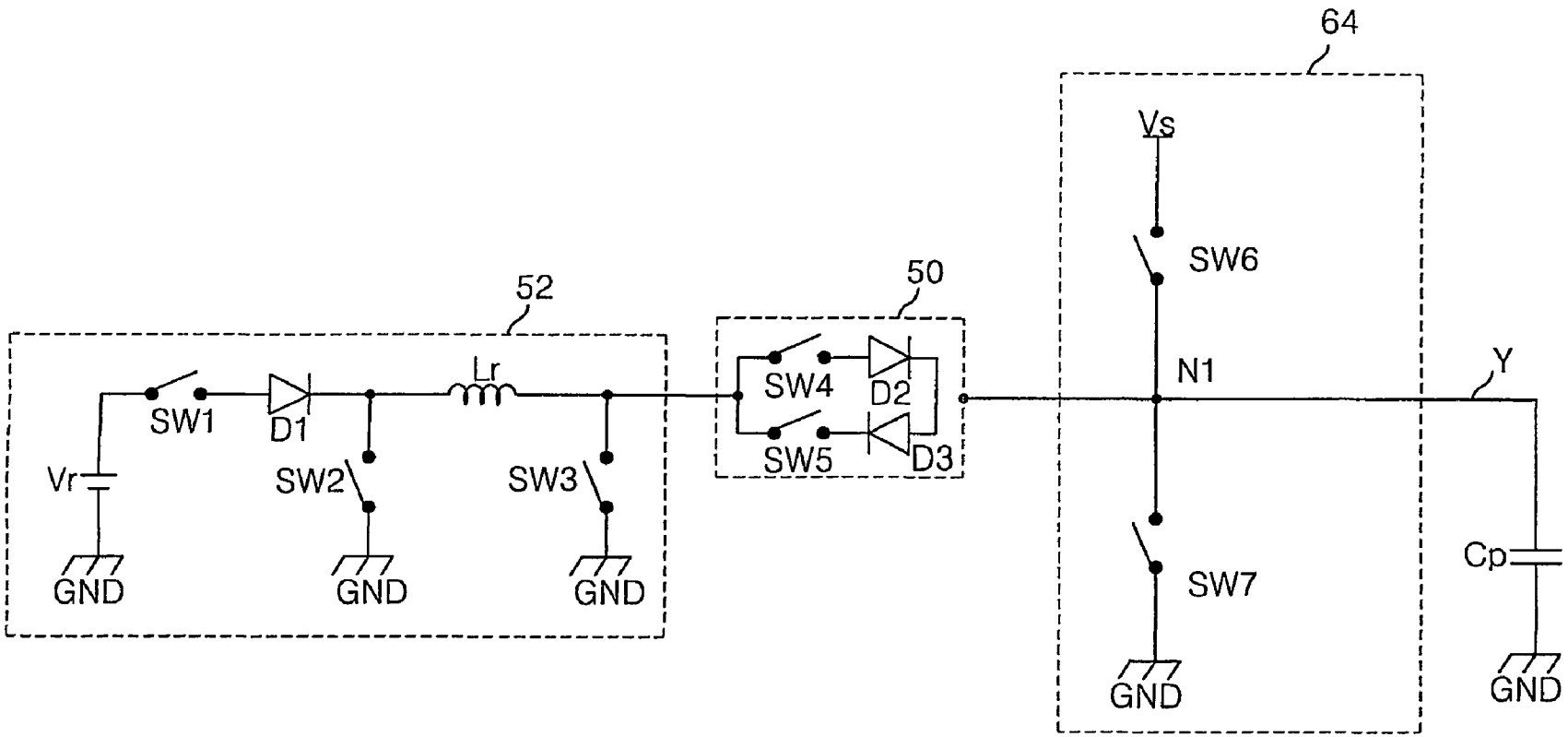
FIG. 15 is a circuit diagram of an initialization waveform generating device according to a fourth embodiment of the present invention.

FIG. 15 shows an initialization waveform generating device according to a fourth embodiment of the present invention.

Referring to FIG. 15, the initialization waveform generating device includes an initialization waveform generating unit 52, an isolating device 50 and an initialization waveform modifying device 64. The initialization waveform modifying device 64 is used for the purpose of controlling a falling start voltage of the initialization waveform. The initialization waveform modifying device 64 includes a sixth switch SW6 connected, in series, between a modifying voltage source Vs and a first node N1, and a seventh switch SW7 provided between the first node N1 and the ground level source GND.

Figure 16:
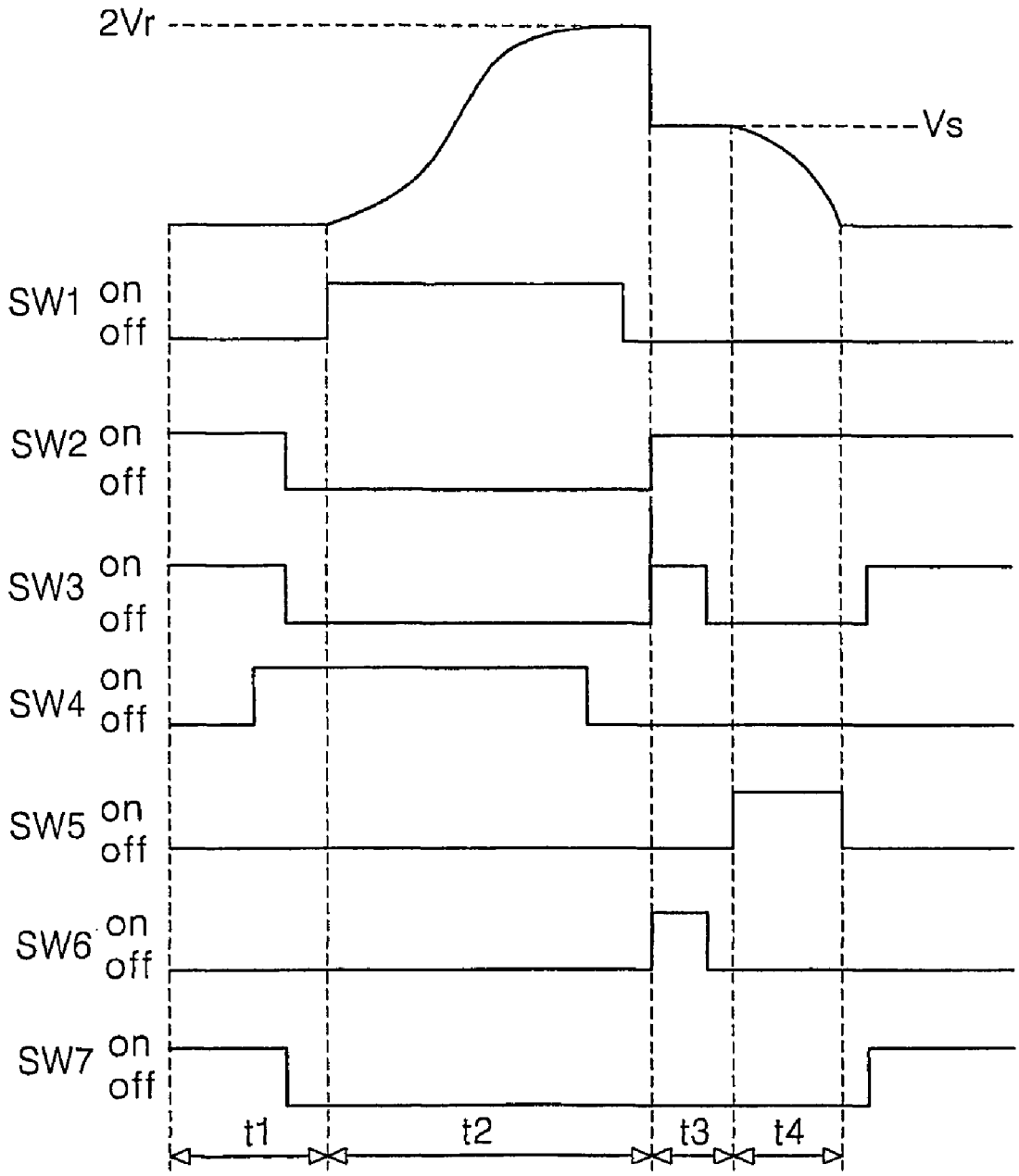
FIG. 16 illustrates an initialization waveform generated from the initialization waveform generating device shown in FIG. 15.

An operation process of the initialization waveform generating device will be described in detail with reference to FIG. 16.

First, at a time t1, the second switch SW2, the third switch SW3 and the seventh switch SW7 are turned on. If the second switch SW2, the third switch SW3 and the seventh switch SW7 are turned on, then the inductor Lr and the panel capacitor Cp are initialized. Thereafter, the fourth switch SW4 is turned on. If the fourth switch SW4 is turned on, then the inductor Lr is electrically connected to the panel capacitor Cp.

After turning-off of the fourth switch SW4, the second switch SW2, the third switch SW3 and the seventh switch SW7 are turned off. Then, the first switch SW1 is turned on at a time t2. If the first switch SW1 is turned on, then a voltage from the initializing voltage source Vr is fed to the inductor Lr and the panel capacitor Cp.

At this time, an initialization waveform with a rising slope is applied to the first electrodes Y owing to a resonance of the inductor Lr and the panel capacitor Cp. The initialization waveform has a voltage value equal to twice the initializing voltage source Vr owing to such a resonance of the inductor Lr and the capacitor Cp. Thereafter, the fourth switch SW4 and the first switch SW1 are turned off. If the fourth switch SW4 and the first switch SW1 are turned off, then a voltage from the initializing voltage source Vr is not applied to the inductor Lr.

At a time t3, the second switch SW2, the third switch SW3 and the sixth switch SW6 are turned on. If the second and third switches SW2 and SW3 are turned on, then the inductor Lr is connected to the ground level source GND to be initialized. If the sixth switch SW6 is turned on, then a voltage from the modifying voltage source Vs is applied to the panel capacitor Cp. In other words, if the sixth switch SW6 is turned on, then a voltage 2Vr charged in the panel capacitor Cp is lowered into a voltage value of the modifying voltage source Vs. At this time, the switches SW4 and SW5 within the isolating device 50 keep a turn-off state. The panel capacitor Cp remains at a modified voltage Vs during a t3 interval. Meanwhile, a voltage value of the modifying voltage source Vs is set to be lower than twice the initializing voltage source Vr, that is, a voltage of 2Vr.

Thereafter, the third switch SW3 and the sixth switch SW6 are turned off. If the sixth switch SW6 is turned off, then the modified voltage Vs is not applied to the panel capacitor Cp. Then, the fifth switch SW5 is turned on. If the fifth switch SW5 is turned on, then the panel capacitor Cp is electrically connected to the inductor Lr.

Accordingly, a voltage charged in the panel capacitor Cp is applied, via the inductor Lr, to the ground level source GND. At this time, a voltage applied to the ground level source GND has a falling slope and falls during a t4 interval owing to a resonance of the panel capacitor Cp and the inductor Lr. Thereafter, the third switch SW3 and the seventh switch SW7 are turned on to thereby initialize the panel capacitor Cp and the inductor Lr.

Figure 17:
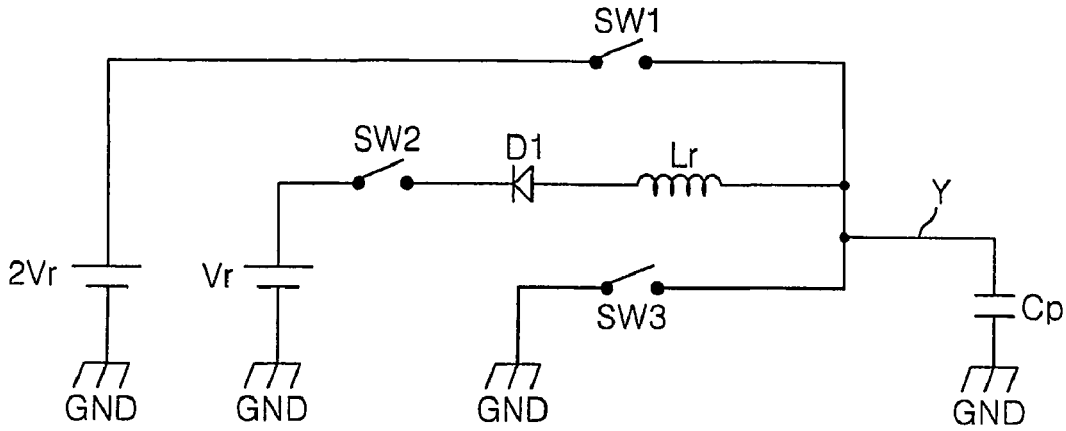
FIG. 17 is a circuit diagram of an initialization waveform generating device according to a fifth embodiment of the present invention.

FIG. 17 shows an initialization waveform generating device according to a fifth embodiment of the present invention. Referring to FIG. 17, the initialization waveform generating device includes a capacitor Cp, a first initializing voltage source Vr, a second initializing voltage source 2Vr, a first switch SW1 provided between the capacitor Cp and the second initializing voltage source 2Vr, a serial connection of a second switch SW2, a diode D1 and an inductor Lr provided between the capacitor Cp and the first initializing voltage source Vr, and a third switch SW3 provided between the capacitor Cp and a ground level source GND.

The capacitor Cp is an equivalent expression of a panel capacitance of the discharge cell. The second initializing voltage source 2Vr supplies a desired voltage such that the capacitor Cp can be charged. The first initializing voltage source Vr is used for setting a falling resonance range. In this embodiment, a voltage of the first initializing voltage source Vr is set to be a half the voltage of the second initializing voltage source 2Vr. Thus, a voltage that begins to fall from 2Vr falls until the ground level. If a voltage of the first initializing voltage source Vr is set to a ground level, then a voltage that begins to fall from 2Vr falls until −2Vr.

The diode D1 controls a current flow to prevent a rising resonant waveform from being applied to the capacitor Cp. The inductor Lr causes a resonance along with the capacitor Cp such that a voltage charged in the capacitor Cp can be discharged at a certain slope.

Figure 18:
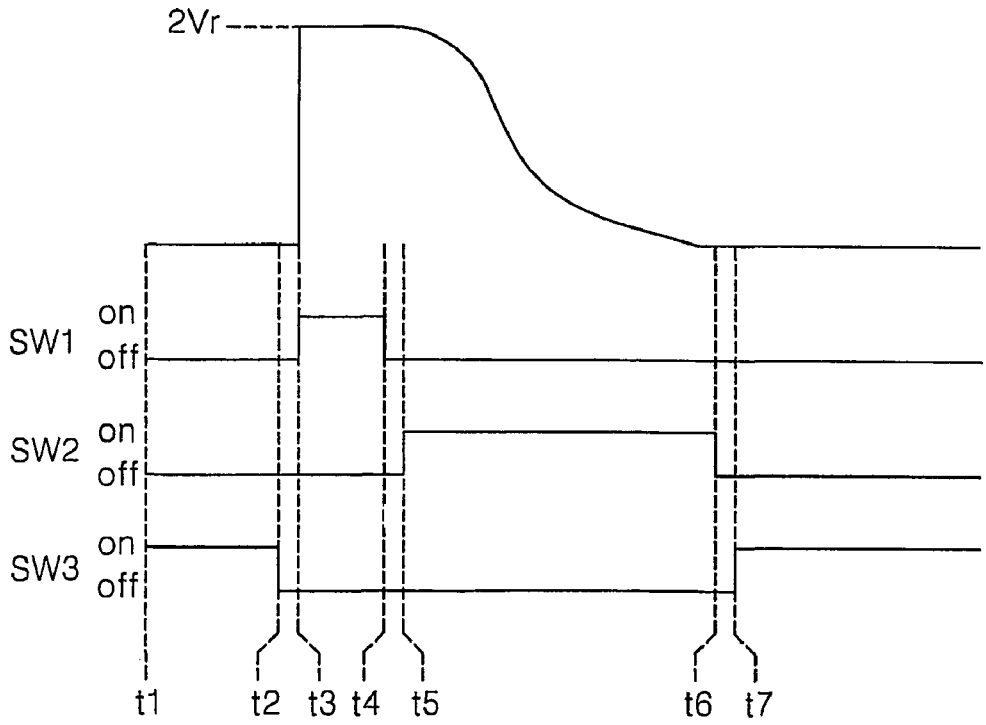
FIG. 18 illustrates an initialization waveform generated from the initialization waveform generating device shown in FIG. 17.

An operation process of the initialization waveform generating device will be described in detail with reference to FIG. 18.

First, at a time t1, the third switch SW3 is turned on. If the third switch SW3 is turned on, then the capacitor Cp is connected to the ground level source GND to be initialized. After initialization of the capacitor Cp, the third switch SW3 is turned off at a time t2.

After turning-off of the third SW1, the first switch SW1 is turned on at a time t3. If the first switch SW1 is turned on, then a voltage from the second initializing voltage source 2Vr is applied to the capacitor cp. Thus, a voltage of 2Vr is charged in the capacitor Cp. Thereafter, the first switch sw1 is turned off at a t4. After turning-off of the switch SW1, the sceond switch SW2 is turned at a time t5. If the second switch SW2 is turned on, then the capacitor cp, the inductor Lt, the diode D1 and the first initializing voltage source Vr ae electrically connected to each other. At this time, the capacitor Cp and the inductor Lr form a resonance circuit. If so, a voltage charged in the capacitor Cp falls until a ground level GND at a certain slope. Thereafter, the second switch SW3 is turned on at a time t7 to thereby initialize the capacitor Cp.

Figure 19:
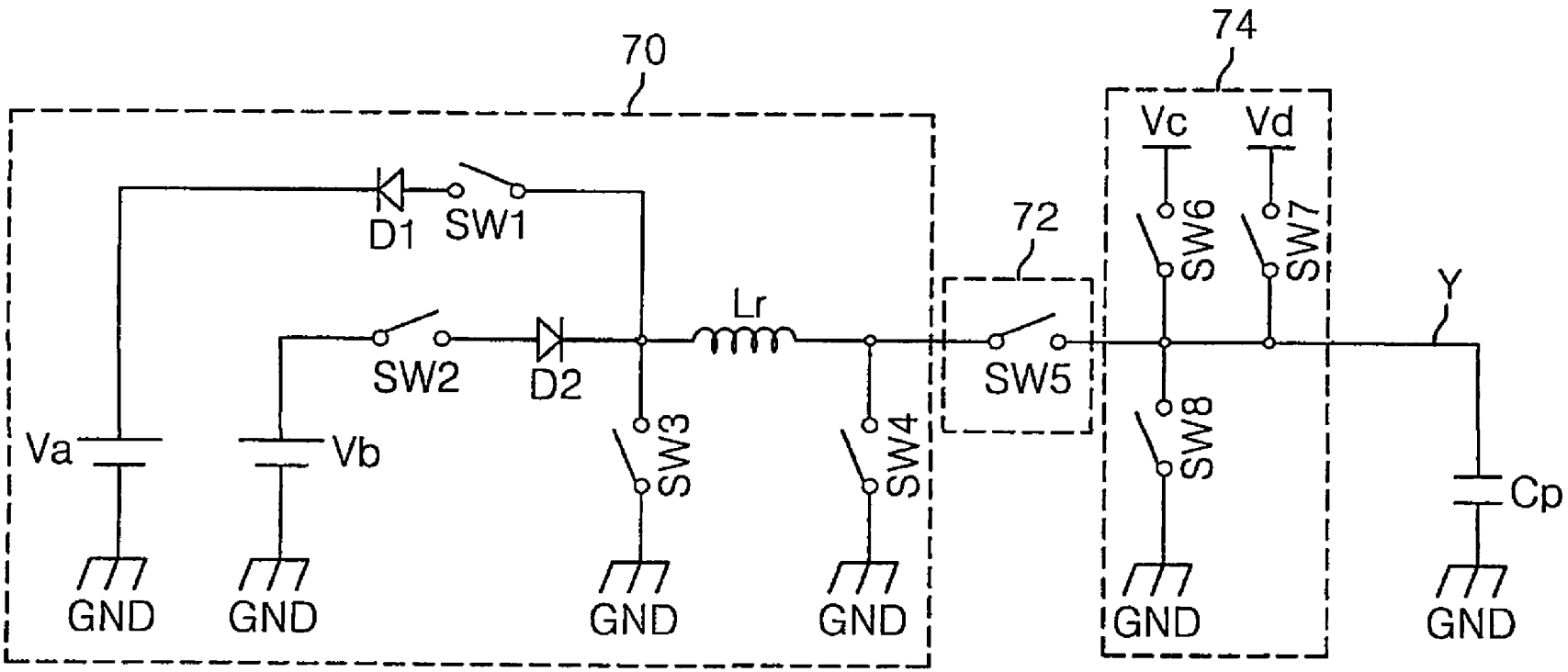
FIG. 19 is a circuit diagram of an initialization waveform generating device according to a sixth embodiment of the present invention.

FIG. 19 shows an initialization waveform generating device according to a sixth embodiment of the present invention.

Referring to FIG. 19, the initialization waveform generating device includes an initialization waveform generating unit 70, an isolating device 72 and an initialization waveform modifying device 74. The initialization waveform modifying device 74 is used for the purpose of controlling falling and rising voltages.

The initialization waveform generating unit 70 includes an inductor Lr connected to the isolating device 72, a first switch SW1 and a first diode D1 connected, in series, between the inductor Lr and a first voltage source Va to provide a discharge path of a voltage charged in a capacitor Cp, and a second switch SW2 and a second diode D2 connected, in series, between the inductor Lr and a second voltage source Vb to provide the capacitor Cp with a charge path.

The first voltage source Va determines a falling resonance range when a voltage charged in the capacitor Cp is discharged. The second voltage source Vb determines a rising resonance range when a voltage charged in the capacitor Cp is charged. The first diode D1 couples the first voltage source Va with a current applied from the capacitor Cp. The second diode D2 couples the capacitor Cp with a current applied from the second voltage source Vb.

Third and fourth switches SW3 and SW4 are arranged at each end of the inductor Lr. The third and fourth switches SW3 and SW4 are connected to the ground level source GND, and are turned on to thereby initialize the inductor Lr.

The initialization waveform modifying device 74 includes a third voltage source Vc, a fourth voltage source Vd, a sixth switch SW6 provided between the third voltage source Vc and the capacitor Cp, a seventh switch SW7 provided between the fourth voltage source Vd and the capacitor Cp, and an eighth switch SW8 provided between the ground level source GND and the capacitor Cp. The third voltage source Vc applies an initial charging voltage to the capacitor Cp when the sixth switch SW6. The fourth voltage source Vd applies a voltage to the capacitor Cp when the seventh switch SW7 is turned on. Thus, if the seventh switch SW7 is turned on, then the capacitor Cp maintains a voltage of Vd. A voltage value of the third voltage source Vc may be set to be identical to or different from that of the fourth voltage source Vd.

The isolating device 72 is provided to isolate an external driver from the initialization waveform generating unit 70.

In other words, the isolating device 72 prevents an initialization waveform from being distorted due to a direct connection of the external driver and the initialization waveform generating unit 70. Such an isolating device 72 includes a fifth switch SW5.

Figure 20:
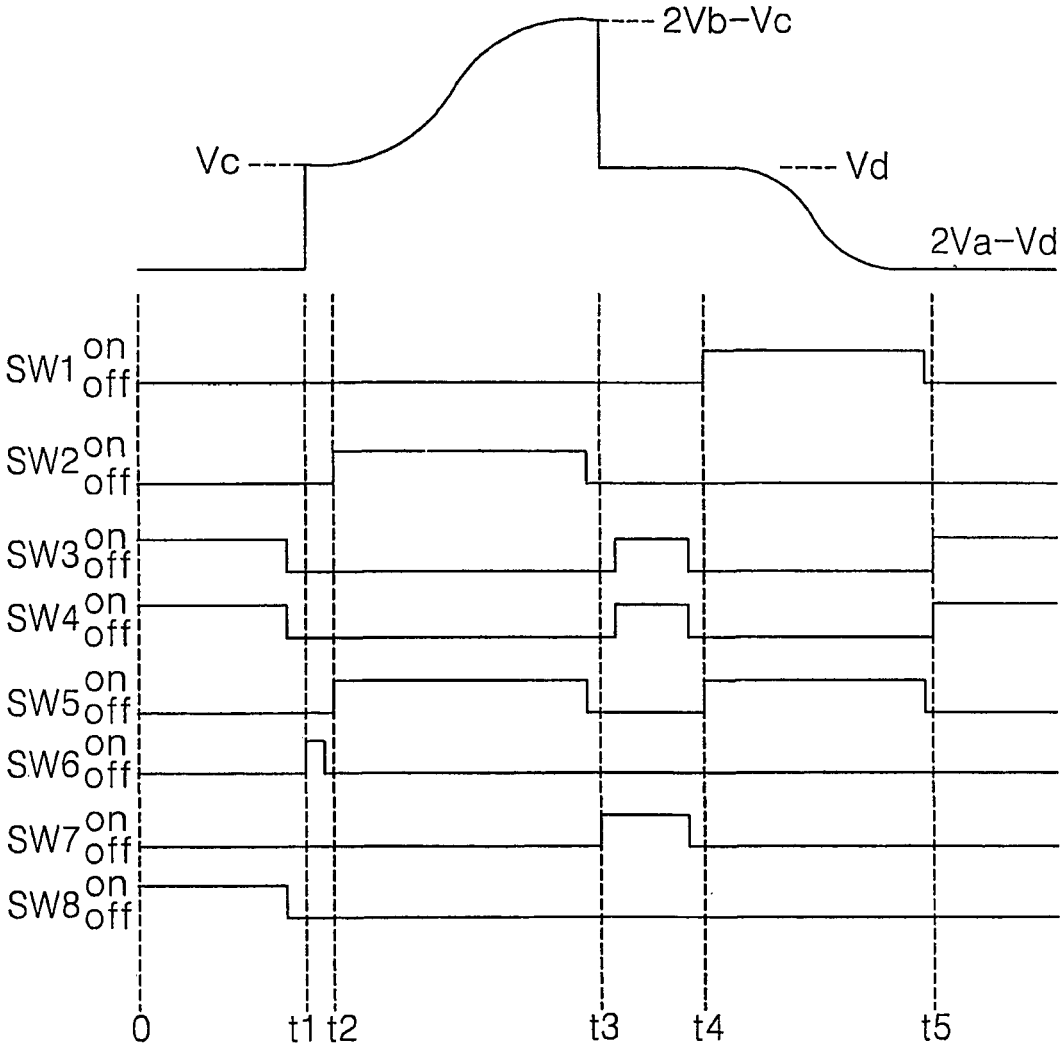
FIG. 20 illustrates an initialization waveform generated from the initialization waveform generating device shown in FIG. 19.

An operation process of the initialization waveform generating device will be described in detail with reference to FIG. 20.

First, the third switch SW3, the fourth switch SW4 and the eighth switch SW8 are turned on. If the third and fourth switches SW3 and SW4 are turned on, then the inductor Lr is initialized. If the eighth switch SW8 is turned on, then the capacitor Cp is initialized. After initialization of the inductor Lr and the capacitor Cp, the third switch SW3, the fourth switch SW4 and the eighth switch SW8 are turned off.

Thereafter, the sixth switch SW6 is turned on at a time t1. If the sixth switch SW6 is turned on, then a voltage from the third voltage source Vc is applied to the capacitor Cp. Thus, a voltage value of the third voltage source Vc is charged in the capacitor Cp. After the voltage value of the third voltage source Vd was charged in the capacitor Cp, the sixth switch SW6 is turned off.

After turning-off of the sixth switch SW6, the second switch SW2 and the fifth switch SW5 are turned on at a time t2. If the second and fifth switches SW2 and SW5 are turned on, then the capacitor Cp, the inductor Lr, the second diode D2 and the second voltage source Vb are electrically connected to each other. Thus, a voltage from the second voltage source Vb is applied, via the second diode D2 and the inductor Lr, to the capacitor Cp.

At this time, a voltage having a rising slope is applied to the capacitor Cp owing to a resonance of the inductor Lr and the capacitor Cp. Meanwhile, a peak-to-peak voltage charged in the capacitor Cp is determined to be (2Vb−Vc). In other words, since a voltage from the third voltage source Vc has been charged in the capacitor Cp, a voltage rises until (2Vb−Vc) owing to such a resonance.

After a voltage of (2Vb−Vc) was charged in the capacitor Cp, the second and fifth switches SW2 and SW5 are turned off. Then, the seventh switch SW7, the third switch SW3 and the fourth switch SW4 are turned on at a time t3. If the seventh switch SW7 is turned on, then the capacitor Cp is connected to the fourth voltage source Vd. Thus, a voltage of (2Vb−Vc) charged in the capacitor Cp falls until Vd. Thereafter, the capacitor Cp maintains a voltage of Vd during a desired time. If the third and fourth switches SW3 and SW4 are turned on, then the inductor Lr is connected to the ground level source GND. Thus, the inductor Lr is initialized.

Subsequently, the third switch SW3, the fourth switch SW4 and the seventh switch SW7 are turned off. After turning-off of the third, fourth and seventh switches SW3, SW4 and SW7, the first and fifth switches SW1 and SW5 are turned on at a time t4. If the first and fifth switches SW1 and SW5 are turned on, then the first voltage source Va, the first diode D1, the inductor Lr and the capacitor Cp are electrically connected to each other. Thus, a voltage charged in the capacitor Cp is applied, via the inductor Lr and the diode D1, to the first voltage source Va.

At this time, a voltage discharged from the capacitor Cp has a falling slope owing to a resonance of the inductor Lr and the capacitor Cp. The capacitor Cp is discharged until a voltage of (2Va−Vd). In other words, since a voltage from the fourth voltage source Vd has been charged in the capacitor Cp, a voltage of the capacitor Cp falls until (2Va−Vd) owing to a resonance.

After a voltage of the capacitor Cp fell until (2Va−Vd), the first switch SW1 and the fifth switch SW5 are turned off. Then, the third switch SW3 and the fourth switch SW4 are turned on at a time t5. If the third and fourth switches SW3 and SW4 are turned on, then the inductor Lr is initialized. In this embodiment, a voltage value of the first voltage source Va is set to be a half the voltage of the fourth voltage source Vd.

The seventh embodiment as described above is shown in FIG. 21 and FIG. 22.

Figure 21:
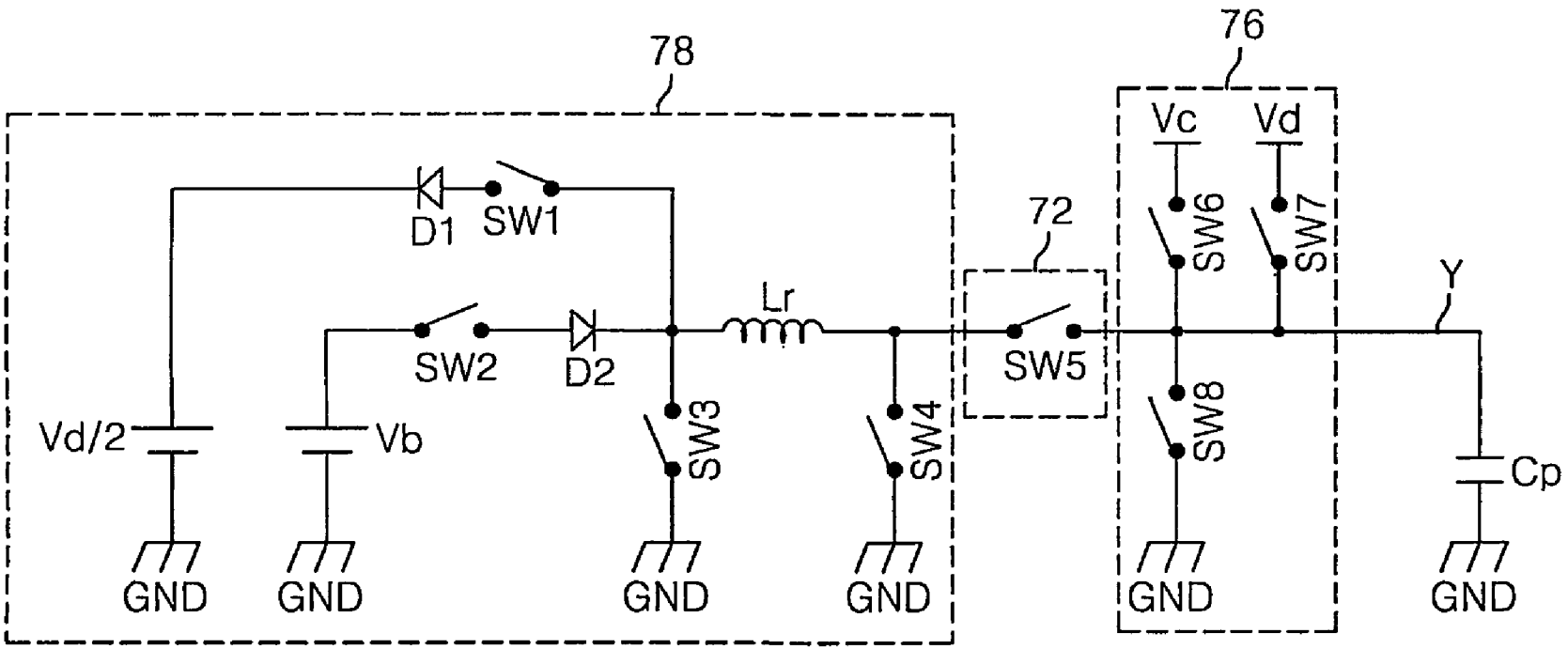
FIG. 21 is a circuit diagram of an initialization waveform generating device according to a seventh embodiment of the present invention.
Figure 22:
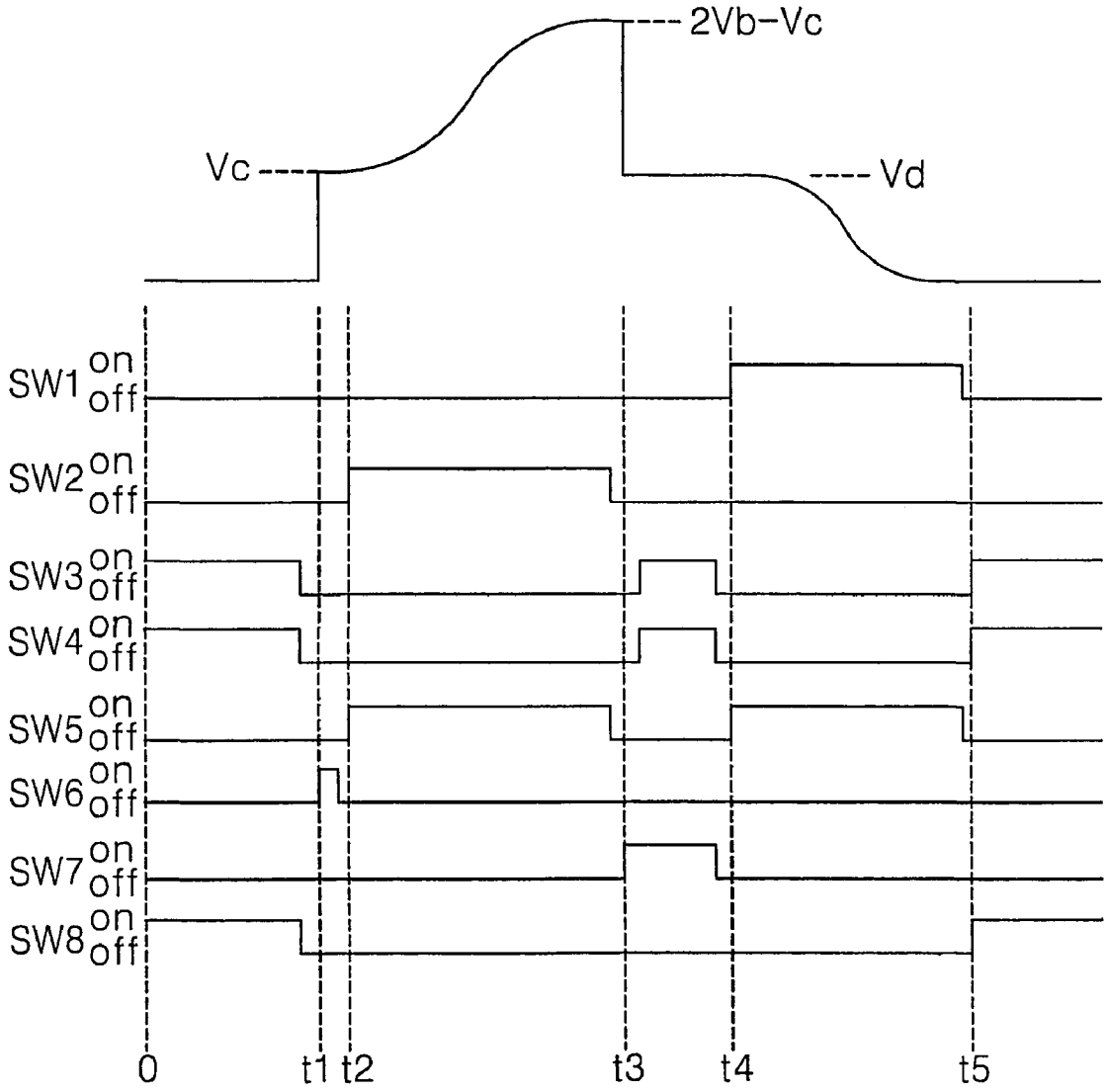
FIG. 22 illustrates an initialization waveform generated from the initialization waveform generating device shown in FIG. 21.

Referring to FIG. 21 and FIG. 22, a voltage value of the first voltage source Vb/2 included in the initialization waveform generating unit 78 in the seventh embodiment is set to be a half the voltage of the fourth voltage source Vd. If so, a voltage charged in the capacitor Cp falls until a ground level GND as shown in FIG. 22.

In operation, first, the third switch SW3, the fourth switch SW4 and the eighth switch SW8 are turned on. If the third and fourth switches SW3 and SW4 are turned on, the inductor Lr is initialized. If the eighth switch SW8 is turned on, then the capacitor Cp is initialized. After initialization of the inductor Lr and the capacitor Cp, the third switch SW3, the fourth switch SW4 and the eighth switch SW8 are turned off.

Thereafter, the sixth switch SW6 is turned on at a time t1. If the sixth switch SW6 is turned on, then a voltage from the third voltage source Vc is applied to the capacitor Cp. Thus, a voltage value of the third voltage source Vd is charged in the capacitor Cp. After a voltage value of the third voltage source Vc was charged in the capacitor Cp, the sixth switch SW6 is turned off.

After turning-off of the sixth switch SW6, the second switch SW2 and the fifth switch SW5 are turned on at a time t2. If the second and fifth switches SW2 and SW5 are turned on, then the capacitor Cp, the inductor Lr, the second diode D2 and the second voltage source Vb are electrically connected to each other. Thus, a voltage from the second voltage source Vb is applied, via the second diode D2 and the inductor Lr, to the capacitor Cp.

At this time, a voltage having a rising slope is applied to the capacitor Cp owing to a resonance of the inductor Lr and the capacitor Cp. Meanwhile, a peak-to-peak voltage charged in the capacitor Cp is determined to be (2Vb−Vc). In other words, since a voltage from the third voltage source Vc has been charged in the capacitor Cp, a voltage rises until (2Vb−Vc) owing to such a resonance.

After a voltage of (2Vb−Vc) was charged in the capacitor Cp, the second and fifth switches SW2 and SW5 are turned off. Then, the seventh switch SW7, the third switch SW3 and the fourth switch SW4 are turned on at a time t3. If the seventh switch SW7 is turned on, then the capacitor Cp is connected to the fourth voltage source Vd. Thus, a voltage of (2Vb−Vc) charged in the capacitor Cp falls until Vd. Thereafter, the capacitor Cp maintains a voltage of Vd during a desired time. If the third and fourth switches SW3 and SW4 are turned on, then the inductor Lr is connected to the ground level source GND. Thus, the inductor Lr is initialized.

Subsequently, the third switch SW3, the fourth switch SW4 and the seventh switch SW7 are turned off. After turning-off of the third, fourth and seventh switches SW3, SW4 and SW7, the first and fifth switches SW1 and SW5 are turned on at a time t4. If the first and fifth switches SW1 and SW5 are turned on, then the first voltage source Vd/2, the first diode D1, the inductor Lr and the capacitor Cp are electrically connected to each other. Thus, a voltage charged in the capacitor Cp is applied, via the inductor Lr and the diode D1, to the first voltage source Vd/2.

At this time, a voltage discharged from the capacitor Cp has a falling slope owing to a resonance of the inductor Lr and the capacitor Cp. The capacitor Cp is discharged until a voltage of (2Vd/2−Vd). Thus, the capacitor Cp falls until a ground level GND.

After a voltage of the capacitor Cp fell until the ground level GND, the third switch SW3, the fourth switch SW4 and the eighth switch SW8 are turned on. If the third and fourth switches SW3 and SW4 are turned on, then the inductor Lr is initialized. If the eighth switch SW8 is turned on, then a ground level GND is applied to the capacitor Cp.

Figure 23:
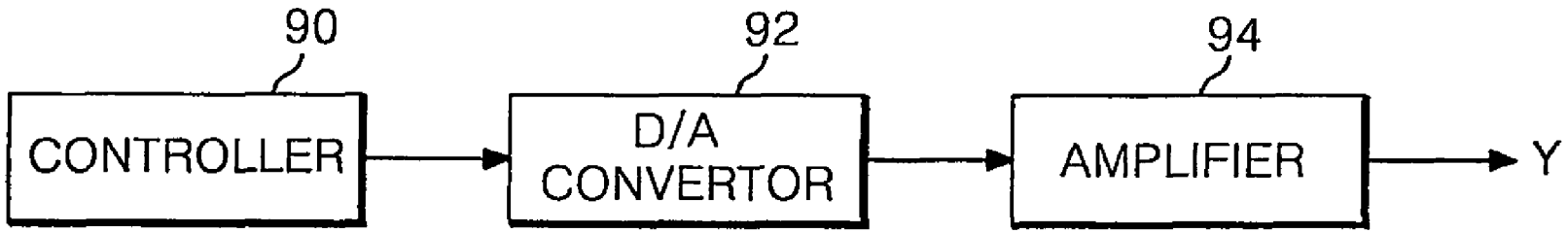
FIG. 23 is a block diagram of an initialization waveform generating device according to an eighth embodiment of the present invention.

FIG. 23 shows an initialization waveform generating device according to an eighth embodiment of the present invention.

Referring to FIG. 23, the initialization waveform generating device includes a controller 90, a digital to analog converter 92, hereinafter referred to as "DA converter", and an amplifier 94.

The controller 90 applies a digital signal capable of producing a sinusoidal wave to the DA converter 92. The DA converter 92 converts a digital signal from the controller 90 into an analog signal. At this time, a low voltage of sinusoidal wave is outputted from the DA converter 92.

The low voltage sinusoidal wave outputted from the DA converter 92 is applied to the amplifier 94. The amplifier 94 amplifies the low voltage sinusoidal wave inputted from the DA converter 92 to apply the same to the first electrode Y of the PDP. At this time, a high voltage of sinusoidal wave having rising and falling slopes is applied to the first electrode Y. Such a sinusoidal wave is used as an initialization waveform.

As described above, according to the present invention, a resonance is used for producing an initialization waveform. Accordingly, a voltage equal to twice the voltage of the initializing voltage source can be supplied to the first electrode, thereby reducing power consumption. Furthermore, resistances of the switching devices are employed to prevent a generation of the initialization waveform, so that it becomes possible to prevent a damage of the switching devices.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display comprising:

providing an initialization waveform in an initialization period by applying a digital signal corresponding to a sinusoidal wave, converting the digital signal into an analog signal, and amplifying the analog signal, wherein the initialization waveform forms wall charges at the plasma display.

2. The method as claimed in claim 1, wherein the sinusoidal wave is generated from a resonance circuit.

3. The method as claimed in claim 2, wherein at least one of rising and falling sinusoidal waves generated from the resonance circuit is used as said initialization waveform.

4. The method as claimed in claim 3, wherein, when said rising sinusoidal wave is applied to a discharge cell, a number of dark discharges are generated within the discharge cell to form a wall charge within the discharge cell; and when said falling sinusoidal wave is applied to the discharge cell, a number of dark discharges are generated within the discharge cell to form uniform wall charges within all the discharge cells.

5. The method as claimed in claim 3, wherein providing said initialization waveform includes:

raising the initialization waveform to a first voltage in a shape of at least part of said sinusoidal wave; and lowering the initialization waveform from the first voltage in a shape of at least part of said sinusoidal wave.

6. A method of driving a plasma display comprising:

providing an initialization waveform in an initialization period by raising the initialization waveform from a prescribed level to a first voltage in a shape of part of a sinusoidal wave, changing the initialization waveform to a second voltage different from the first voltage, maintaining the initialization waveform at the second voltage, and lowering the initialization waveform from the second voltage in a shape of another part of said sinusoidal wave.

7. A method of driving a plasma display comprising:

providing an initialization waveform in an initialization period by raising the initialization waveform from a prescribed level to a ftrst voltage, raising the initialization waveform from the first voltage to a second voltage in a shape of part of a sinusoidal wave, changing the initialization waveform to a third voltage different from the second voltage, maintaining the initialization waveform at the third voltage, and lowering the initialization waveform from the third voltage in a shape of another part of said sinusoidal wave.

8. The method as claimed in claim 7, wherein a voltage value of the third voltage is lower than a voltage value of the second voltage.

9. The method as claimed in claim 7, wherein a voltage value of the first voltage is equal to a voltage value of the third voltage.

10. The method as claimed in claim 7, wherein said initialization waveform falls from the third voltage to the prescribed level in the shape of said another part of the sinusoidal wave.

11. The method as claimed in claim 7, wherein said initialization waveform falls from the third voltage to a negative voltage level in the shape of said another part of the sinusoidal wave.

12. The method as claimed in claim 6, wherein the prescribed level comprises a ground level.

13. The method as claimed in claim 6, wherein the initialization waveform is provided to discharge cells of the plasma display.

14. The method as claimed in claim 6, wherein the part of the sinusoidal wave comprises a rising part of the sinusoidal wave.

15. The method as claimed in claim 6, wherein the another part of the sinusoidal wave comprises a falling part of the sinusoidal wave.

16. The method as claimed in claim 6, wherein the initialization waveform is provided along electrode lines to the plasma display.

17. The method as claimed in claim 16, further comprising applying sustain pulses to the electrode lines in a sustaining period.

18. The method as claimed in claim 6, wherein providing the initialization waveform comprises providing the initialization waveform from a resonance circuit.

19. The method as claimed in claim 7, wherein the prescribed level comprises a ground level.

20. The method as claimed in claim 7, wherein the initialization waveform is provided to discharge cells of the plasma display.

21. The method as claimed in claim 7, wherein the part of the sinusoidal wave comprises a rising part of the sinusoidal wave.

22. The method as claimed in claim 7, wherein the another part of the sinusoidal wave comprises a falling part of the sinusoidal wave.

23. The method as claimed in claim 7, wherein the initialization waveform is provided along electrode lines to the plasma display.

24. The method as claimed in claim 23, further comprising applying sustain pulses to the electrode lines in a sustaining period.

25. The method as claimed in claim 7, wherein providing the initialization waveform comprises providing the initialization waveform from a resonance circuit.

26. The method as claimed in claim 6, wherein the initialization waveform form wall charges at the plasma display.

27. The method as claimed in claim 7, wherein the initialization waveform form wall charges at the plasma display.

* * * * *